US008474808B2

(12) United States Patent
Matsuo

(10) Patent No.: US 8,474,808 B2
(45) Date of Patent: Jul. 2, 2013

(54) SHEET POST-PROCESSING APPARATUS AND IMAGE FORMING APPARATUS

(75) Inventor: Takeshi Matsuo, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 202 days.

(21) Appl. No.: 13/071,409

(22) Filed: Mar. 24, 2011

(65) Prior Publication Data

US 2011/0233842 A1 Sep. 29, 2011

(30) Foreign Application Priority Data

Mar. 26, 2010 (JP) ..... 2010-072118

(51) Int. Cl.
*B65H 37/04* (2006.01)

(52) U.S. Cl.
USPC ..... 270/58.08; 399/410

(58) Field of Classification Search
USPC ..... 270/58.08; 399/410
See application file for complete search history.

(56) References Cited

U.S. PATENT DOCUMENTS 5,842,624 A * 12/1998 Ishida ..... 227/111
6,092,712 A * 7/2000 Rueckl ..... 227/111
6,164,511 A * 12/2000 Chung et al. ..... 227/148
6,343,785 B1 * 2/2002 Yamada et al. ..... 270/58.08
6,402,006 B1 * 6/2002 Nunes et al. ..... 227/110
6,427,997 B1 * 8/2002 Hirota et al. ..... 270/58.12
7,083,073 B2 * 8/2006 Yoshie et al. ..... 227/111
7,207,556 B2 * 4/2007 Saitoh et al. ..... 270/58.08
7,681,873 B2 * 3/2010 Tsutsui et al. ..... 270/58.08
7,832,718 B2 * 11/2010 Fukasawa et al. ..... 270/58.07

FOREIGN PATENT DOCUMENTS

JP 2000-335815 12/2000
JP 2001-31323 A 2/2001
JP 2001-220051 8/2001

OTHER PUBLICATIONS

Notice of Reasons for Rejection issued to JP Application No. 2010-072118, mailed Apr. 17, 2012.

* cited by examiner

*Primary Examiner* — Patrick Mackey
(74) *Attorney, Agent, or Firm* — Knobbe Martens Olson & Bear LLP

(57) ABSTRACT

A sheet post-processing apparatus implements a tilted edge-binding process by a movable table rectilinearly driving portion that moves a stapling unit rectilinearly via a movable table, and rotating the stapling unit to drive a staple near a sheet corner when the staple is tilted at a predetermined angle with respect to a sheet-conveying direction. The sheet post-processing apparatus includes the movable-table rotationally driving portion that rotates the movable table to cause the stapling unit to tilt at a position to drive the staple at the predetermined angle with respect to the sheet-conveying direction, and a tilt retention portion that mechanically holds the movable table to maintain the stapling unit tilted.

4 Claims, 31 Drawing Sheets

SHEET POST-PROCESSING APPARATUS AND IMAGE FORMING APPARATUS

This application is based on and claims the benefit of priority from Japanese Patent Application No. 2010-072118, filed on 26 Mar. 2010, the content of which is incorporated herein by reference.

BACKGROUND OF THE INVENTION

1. Field of the Invention

The present invention relates to a sheet post-processing apparatus that performs post-processing such as stapling sheets on which images are formed in an image forming main body, and an image forming apparatus including the image forming main body and the sheet post-processing apparatus.

2. Related Art

Conventionally, a sheet post-processing apparatus has been used, which performs post-processing on a sheet (or a stack of sheets) on which an image is formed in an image forming main body such as a copy machine, a multi-functional device and the like. The sheet post-processing apparatus is disposed adjacently to the image forming main body. As the post-processing, punching processing on a sheet, staple processing on s stack of sheets, and double- and triple-fold processing on a sheet (a stack of sheets) are exemplified.

Tilted end-binding processing is one example of the staple processing. Tilted end-binding is a process for driving a staple into sheets in a vicinity of a corner of the sheets while the staple is tilted with respect to a direction of conveyance of a sheet. Sheet post-processing apparatuses capable of tilted end-binding processes are equipped with a stapling unit that staples a stack of sheets that is obtained through stack processing performed for a plurality of sheets, a movable table that is rectilinearly movable in unison with the stapling unit in a perpendicular direction perpendicular to a direction of conveyance of a sheet, a rectilinearly driving portion that rectilinearly moves the movable table in the perpendicular direction, and a rotationally driving portion that tilts the movable table so that the stapling unit tilts to a staple-driving position to drive a staple at an angle with respect to the direction of the conveyance of a sheet.

With this kind of sheet post-processing apparatus, the rectilinearly driving portion rectilinearly moves the stapling unit via the movable table and the rotationally driving portion rotates the stapling unit via the movable table. In this manner, the sheet post-processing apparatus implements the tilted edge-binding process by driving the staple near a corner of sheets while the staple is tilted with respect to the direction of the conveyance of a sheet.

It is necessary for the sheet post-processing apparatuses capable of the tilted edge-binding process to maintain the stapling unit tilted. For example, a setup to maintain a stapling unit tilted has been considered. It employs a rotationally driving portion with a motor for rotating a movable table so as to tilt a stapling unit and a locking mechanism to electrically lock the rotation of the motor.

SUMMARY OF THE INVENTION

In the sheet post-processing apparatus equipped with the rotationally driving portion configured electrically to lock the rotation of the motor, it is not possible to allow replenishing of staples in the tilted stapling unit if drive unit power must be turned off while a housing cover of the sheet post-processing apparatus is open.

An object of the present invention is to provide a sheet post-processing apparatus that maintains a stapling unit tilted without electrically locking an actuator such as a motor for rotational drive of the stapling unit, in a sheet post-processing apparatus that drives a staple near a corner of a sheet in a state where the stapling unit is tilted with respect to a direction of conveyance of a sheet.

Another object of the present invention is to provide an image forming apparatus equipped with the sheet post-processing apparatus.

The present invention relates to a sheet post-processing apparatus, which includes a stapling unit, a movable table, a rectilinearly driving portion, a rotationally driving portion and a tilt retention portion. The stapling unit is configured to drive a staple into a plurality of stacked sheets. The movable table is configured to rectilinearly move in unison with the stapling unit in a perpendicular direction perpendicular to a direction of conveyance of a sheet. The rectilinearly driving portion is configured to rectilinearly move the movable table in the perpendicular direction and causes the stapling unit to rectilinearly move through the movable table, such that the sheet post-processing apparatus performs tilted stapling with the stapling unit that drives the staple into the plurality of stacked sheets in a vicinity of a corner thereof in such a manner that the staple has a predetermined angle with respect to the direction of the conveyance of a sheet. The rotationally driving portion is configured to cause the movable table to rotate such that the stapling unit is tilted so as to drive the staple at the predetermined angle with respect to the direction of the conveyance of a sheet. The tilt retention portion is configured to mechanically hold the movable table such that the stapling unit maintains a tilted state.

The present invention provides the sheet post-processing apparatus that maintains the stapling unit tilted without electrically locking the actuator such as the motor for rotational drive of the stapling unit, in the sheet post-processing apparatus that drives the staple near the corner of a sheet in the state where the stapling unit is tilted with respect to the direction of the conveyance of a sheet.

In addition, the present invention provides the image forming apparatus equipped with the sheet post-processing apparatus.

DETAILED DESCRIPTION OF THE INVENTION

Figure 1:
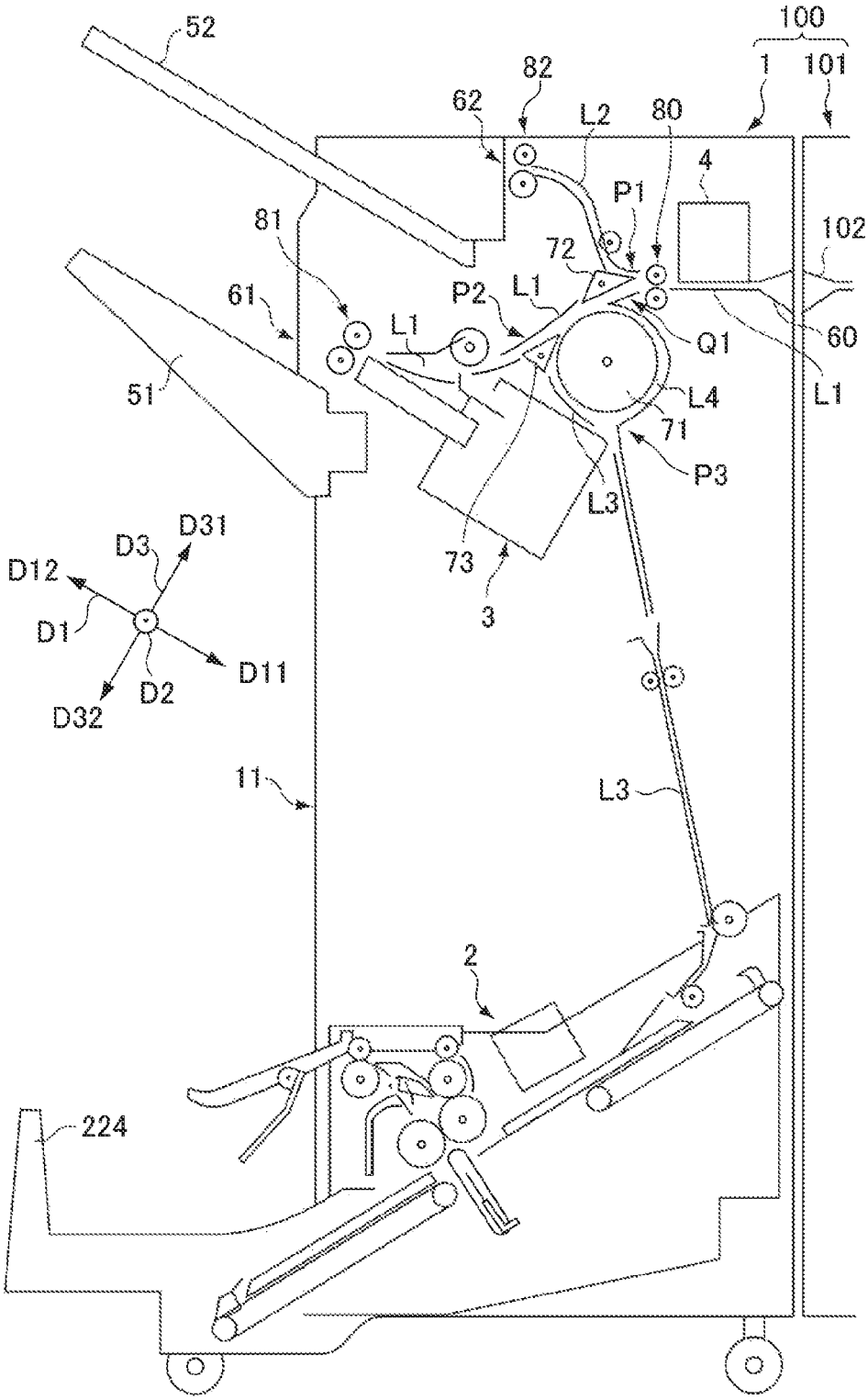
FIG. 1 is a schematic sectional view illustrating an outline of a main unit 101 that composes a multi-functional device 100 and sheet post-processing apparatus 1 as an embodiment of the present invention.

A multi-functional printer 100 as an embodiment of an image forming apparatus according to the present invention is described hereinafter with reference to the drawings. FIG. 1 is a schematic cross-sectional view illustrating an outline of a multi-functional printer main body 101 constituting a multi-functional printer 100 and a sheet post-processing apparatus 1. As shown in FIG. 1, the multi-functional printer 100 of the present embodiment includes: a multi-functional printer main body 101 as an image forming main body including an image forming unit (not shown) that forms an image on a sheet; and the sheet post-processing apparatus 1.

The multi-functional printer main body 101 includes an image forming unit (not shown) that forms an image on a sheet such as paper, and a main body ejection portion 102 that ejects the sheet, on which an image is formed (printed) by the image forming unit, toward the sheet post-processing apparatus 1 and the like.

As shown in FIG. 1, the sheet post-processing apparatus 1 carries a sheet T, on which an image is formed in the multi-functional printer main body 101, ejected from the multi-functional printer main body 101, into a housing 11 of the sheet post-processing apparatus 1 via a carry-in portion 60 provided in an upper portion of a right lateral face of the sheet post-processing apparatus 1. Thereafter, post-processing such as staple processing and fold processing is performed on the sheet T being carried in.

The sheet post-processing apparatus 1 includes a sheet fold processing unit 2, a staple processing unit 3, a punching unit 4, a main ejection tray 51, and a secondary ejection tray 52. In addition, the sheet post-processing device 1 includes the carry-in portion 60, a first path L1, a second path L2, a third path L3, a first branch portion P1, a second branch portion P2, a third branch portion P3, a first junction Q1, the main ejection portion 61, the secondary ejection portion 62, an evacuation drum 71, various switching members, and various rollers and roller pairs.

First, a configuration regarding conveyance of the sheet T is described.

The carry-in portion 60 is a portion through which the sheet T is carried in, which is ejected from the main body ejection portion 102 of the multi-functional printer main body 101.

The first path L1 conveys the sheet T carried in through the carry-in portion 60 to the main ejection portion 61. The sheet T ejected from the main ejection portion 61 is ejected to the main ejection tray 51.

The second path L2 branches off from the first path L1 at the first branch portion P1. The second path L2 conveys the sheet T being conveyed in the first branch portion P1 to the secondary ejection portion 62. The sheet T ejected from the secondary ejection portion 62 is ejected to the secondary ejection tray 52.

The third path L3 branches off from the first path L1 at the second branch portion P2 and extends up to the sheet folding processing unit 2. The second branch portion P2 is positioned downstream of the first branch portion P1 in the first path L1.

The fourth path L4 branches off from the third path L3 at the third branch portion P3, curves along a periphery of the evacuation drum 71, and joins the first path L1 at the first junction Q1. The first junction Q1 is positioned between the first branch portion P1 and the second branch portion P2 in the first path L1.

A first intermediate roller pair 80 is disposed in front of the first branch portion P1 in the first path L1. The first intermediate roller pair 80 sends the sheet T downstream, being conveyed in front of the first branch portion P1 in the first path L1.

A first switching arm 72 is provided in the first branch portion P1. The first switching arm 72 switches a delivery destination of the sheet T, being conveyed on the first path L1, between the first path L1 and the second path L2.

A second switching arm 73 is provided in the second branch portion P2. The second switching arm 73 switches a delivery destination of the sheet T, being conveyed on the first path L1, between the first path L1 and the third path L3.

The punching unit 4 is disposed to face a region between the carry-in portion 60 and the first branch portion P1 in the first path L1. The punching unit 4 performs punching processing on the sheet T at predetermined timing.

A main ejection roller pair 81 is disposed on an end portion of the first path L1 and in a vicinity of the main ejection portion 61. The main ejection roller pair 81 sends the sheet T, being conveyed in the end portion of the first path L1, to the main ejection tray 51. In addition, when sending the sheet T to the staple processing unit 3, the main ejection roller pair 81 is spaced away from each other and unlocks a nip. Thereafter, the sheet is sent to the staple processing unit 3 by a sheet dispatching mechanism (not shown).

The main ejection tray 51 receives the sheet T ejected by the main ejection roller pair 81 from the main ejection portion 61.

The main ejection tray 51 mainly receives a stack of sheets T ejected from the main ejection portion 61 after the staple processing performed in the staple processing unit 3. The main ejection tray 51 is lowered sequentially from the uppermost position, according to an increase in the number of stacks of the sheets T ejected. Thereafter, the main ejection tray 51 moves up when the stacks of the sheets T are removed therefrom and returns to a normal position.

Alternatively, the sheet post-processing apparatus 1 can be configured such that the main ejection tray 51 receives the sheet T being ejected without post-processing or only with punching.

A secondary ejection roller pair 82 is disposed at an end portion of the second path L2 and in a vicinity of the secondary ejection portion 62. The secondary ejection roller pair 82 sends the sheet T, being conveyed in the end portion of the second path L2, to the secondary ejection tray 52. The secondary ejection tray 52 receives the sheet T ejected by the secondary ejection roller pair 82 from the secondary ejection portion 62. The secondary ejection tray 52 mainly receives the sheet T being ejected without post-processing or only with punching performed in the sheet post-processing apparatus 1.

The sheet folding processing unit 2 is disposed at a lower portion of the housing 11. The sheet folding processing unit 2 is positioned at the lowermost portion of the housing 11 of the sheet post-processing apparatus 1. The sheet folding processing unit 2 is disposed downstream of the third path L3. A stack of stapled sheets T is mainly guided into the sheet folding processing unit 2. Accordingly, the sheet folding processing unit 2 mainly implements a folding process on the stack of sheets T. Upon selection of folding processing by a user, the sheet folding processing unit 2 performs the folding process, such as a double-fold, triple-fold and the like on the stack of sheets T, and ejects the stack of sheets T undergone folding to a lower ejection tray 224 disposed in a lower portion of a side face of the housing 11 of the sheet post-processing apparatus 1.

The staple processing unit 3 implements a stacking process that stacks a plurality of sheets T to form a stack of sheets T. The staple processing unit 3 is capable of a variety of stapling processes (such as using a staple to bind edges of stacked sheets T). For example, end-binding processes include a "central end-binding process" where a stack of sheets T is stapled along a length direction at two positions near a central location at an edge thereof, or an "edge tilted-binding process" where a corner of a leading edge of the stacked sheets T is stapled at one location at a 45-degree tilting angle. The stack of sheets T undergone the stacking process or end-binding is ejected from the main ejection portion 61 by the main ejection roller pair 81.

The evacuation drum 71 conveys a sheet T, which is branched from the first path L1 and conveyed in the third path L3, to the fourth path L4, so that the sheet T is circulated via the first path L1. In this manner, the sheet T is temporarily evacuated. When the stapling process is performed for a plurality of stacks of sheets T, the evacuation drum 71 idles with one or a plurality of sheets T wrapped therearound, while the stapling process is being performed for a previous stack of sheets T. Because of this functionality of the evacuation drum 71, there is no need to temporarily pause the ejection of a sheet T from the main unit 101. Accordingly, the productivity is increased.

Next, structural details of the staple processing unit 3 of the sheet post-processing apparatus 1 according to the present invention will now be explained with reference to FIGS. 2A-10B.

Figure 2A:
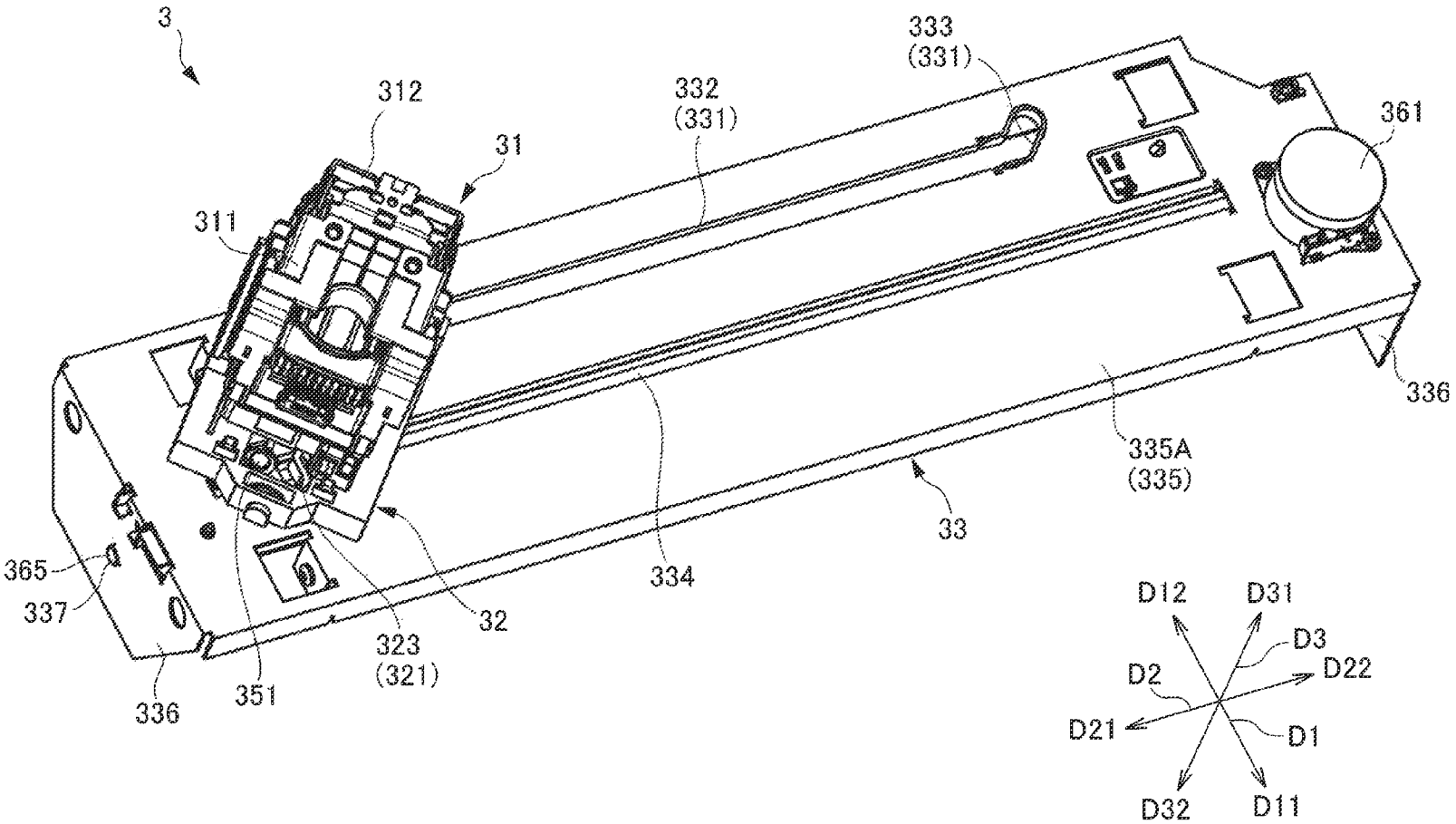
FIG. 2A is a perspective view of a stapler 31 in a staple processing unit 3, in a tilted state, at a front side of the sheet post-processing apparatus 1 shown in FIG. 1.
Figure 2B:
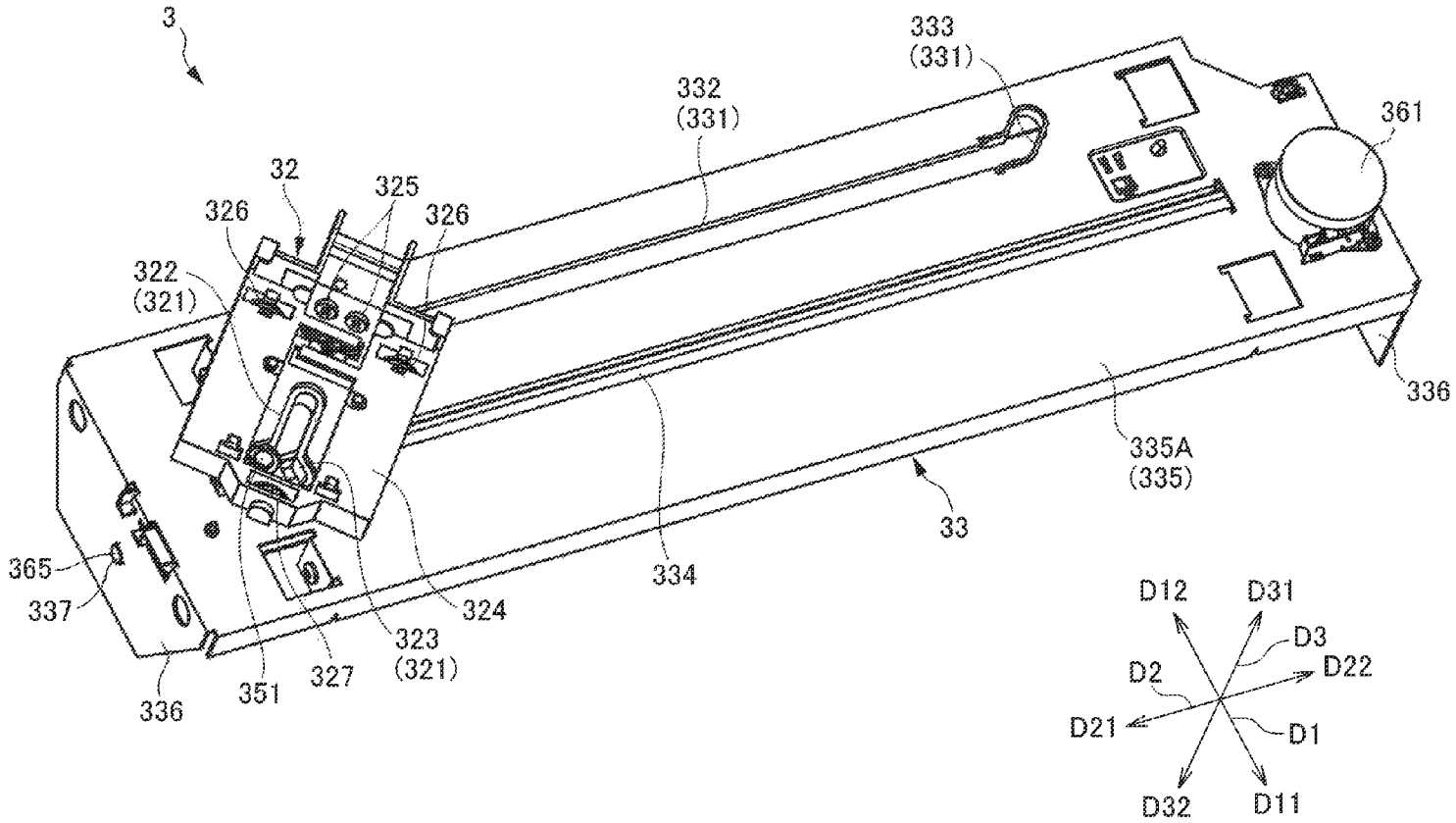
FIG. 2B is a view showing a movable table 32 in an exposed state, with the stapler 31 removed from FIG. 2A.
Figure 2C:
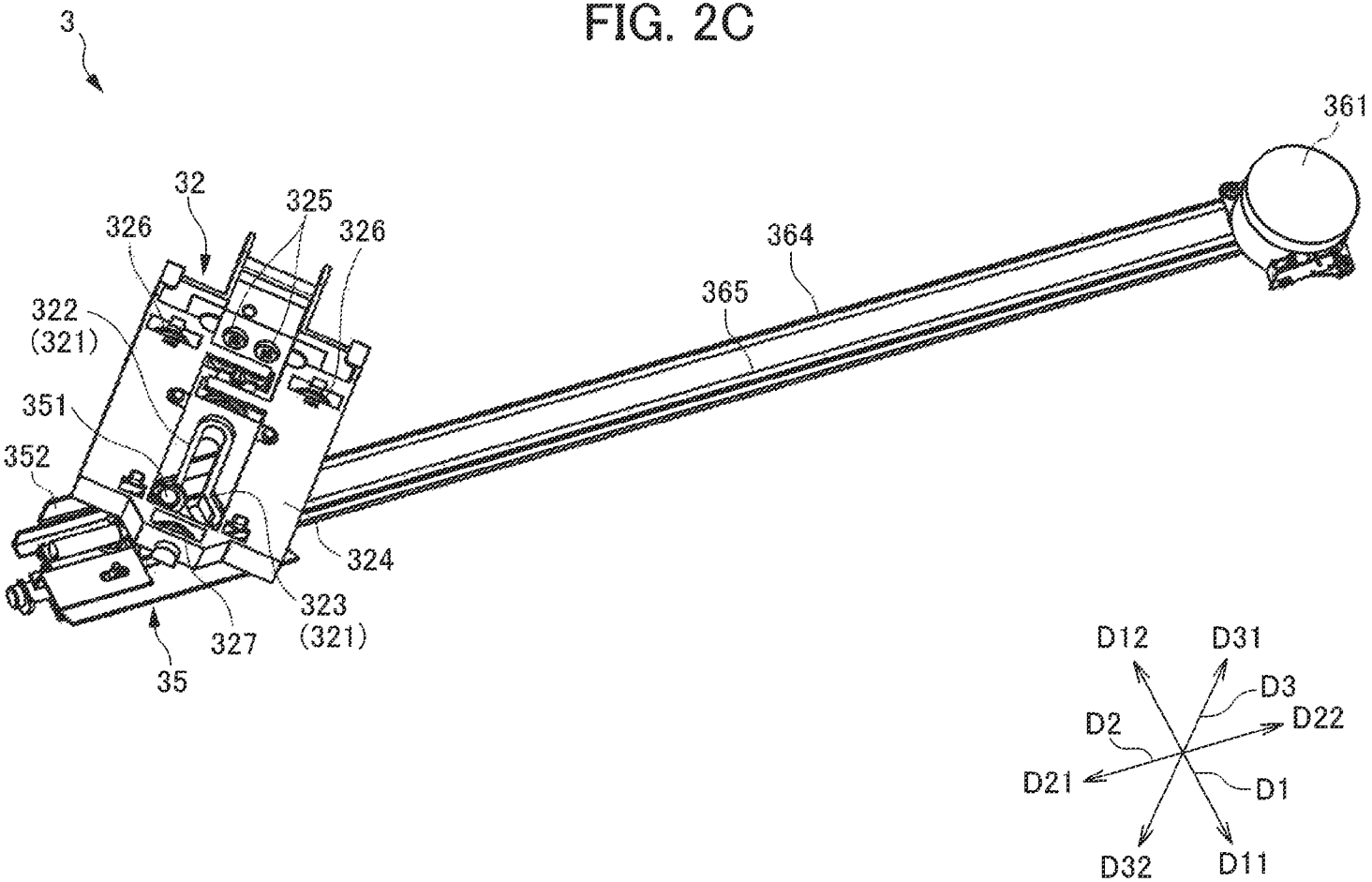
FIG. 2C is a view virtually showing a state with a base member 33 removed from FIG. 2B.
Figure 2D:
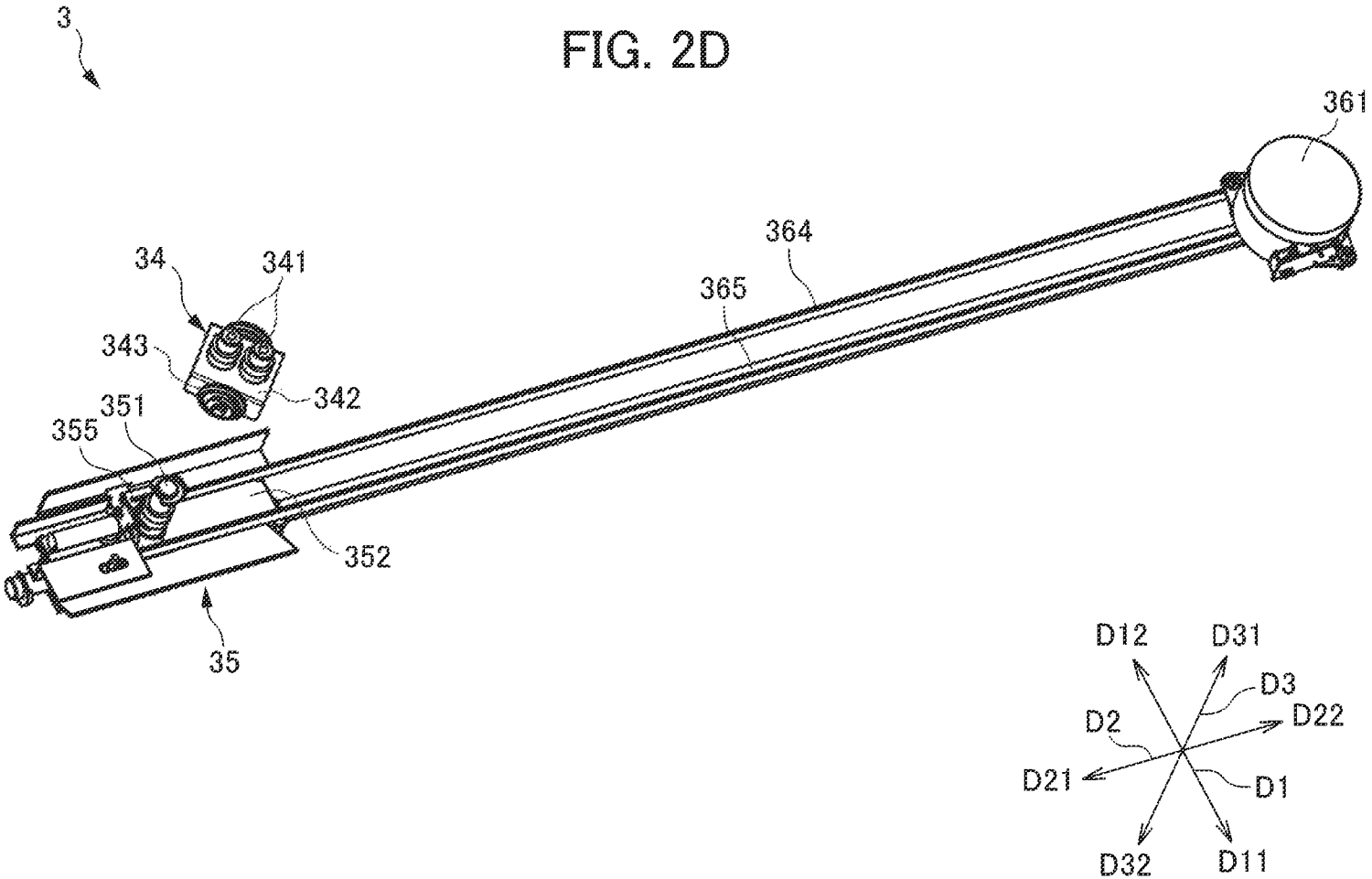
FIG. 2D is a view showing a state with the movable table 32 removed from FIG. 2C.
Figure 2E:
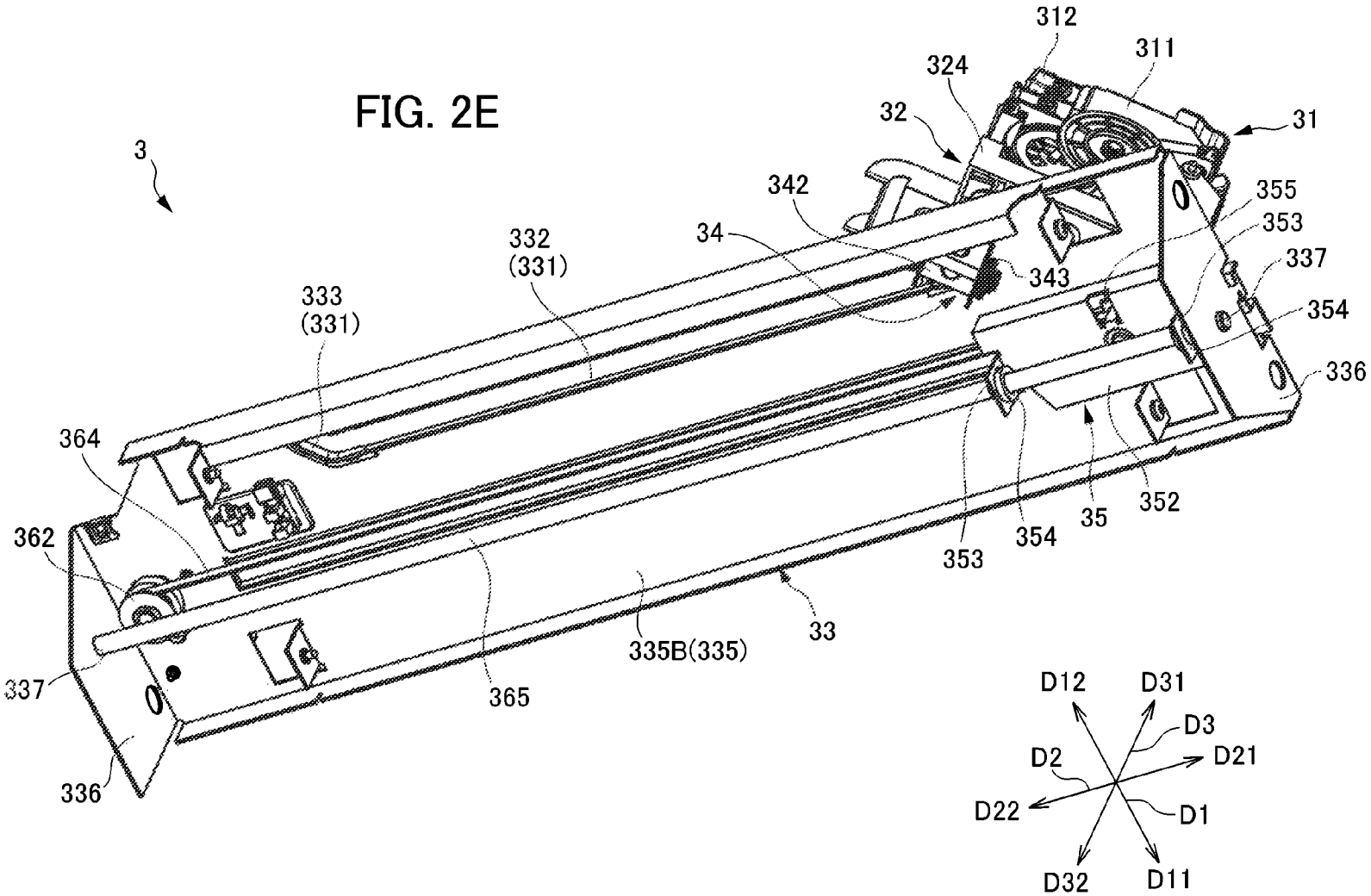
FIG. 2E is a perspective view of the state shown in FIG. 2A when viewed from a lower direction.

FIG. 2A is a perspective view showing the stapler 31 of the staple processing unit 3 in a tilted state at a front side of the sheet post-processing apparatus 1 shown in FIG. 1. FIG. 2B is a view showing the movable table 32 to be exposed with the stapler 31 removed from FIG. 2A. FIG. 2C is a virtual view in which the base member 33 is removed from FIG. 2B. FIG. 2D is a view in which the movable table 32 is removed from FIG. 2C. FIG. 2E is a perspective view of the state shown in FIG. 2A when viewed from a lower direction.

Figure 3A:
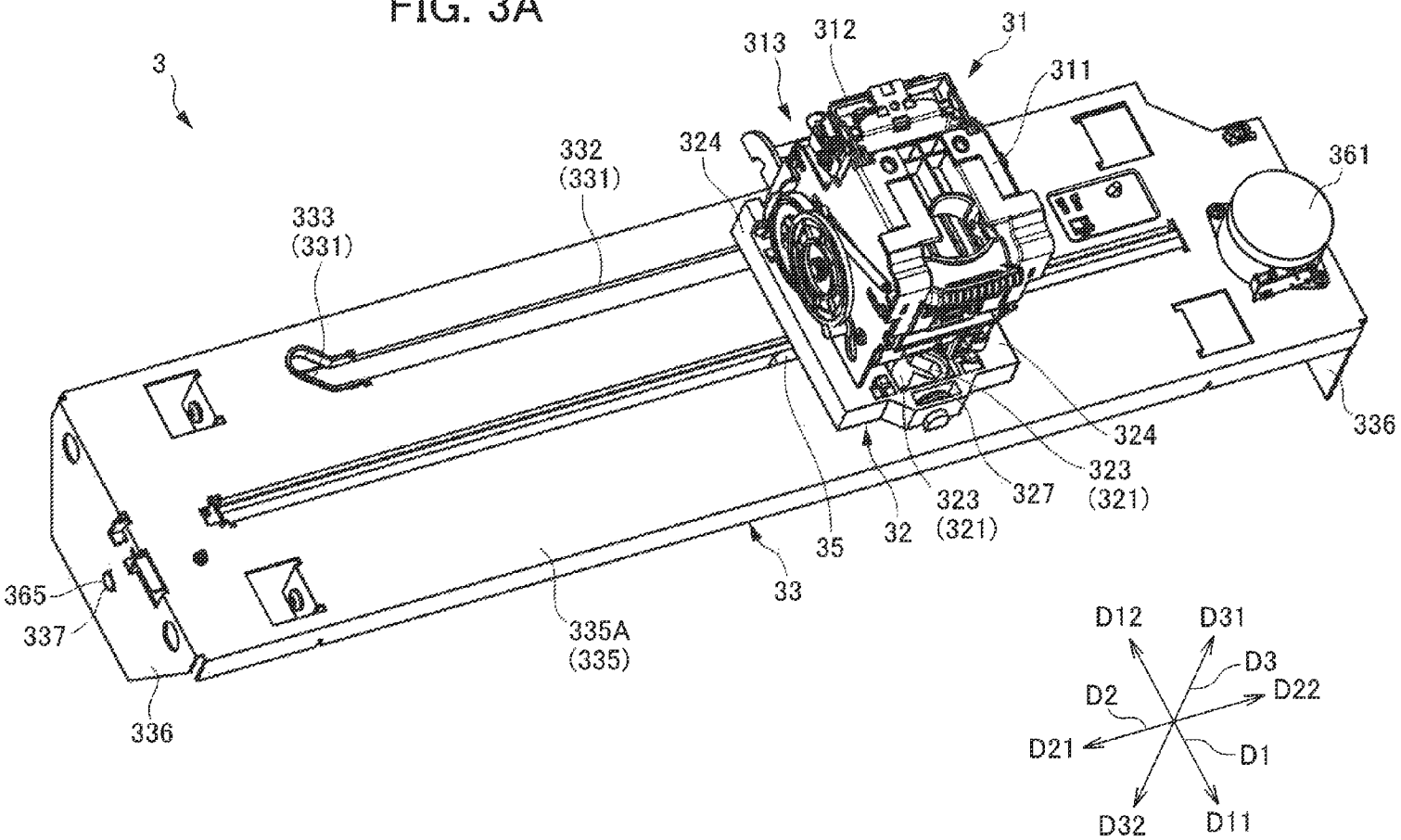
FIG. 3A is a perspective view showing a state where the stapler 31 in the staple processing unit 3 is not tilted.
Figure 3B:
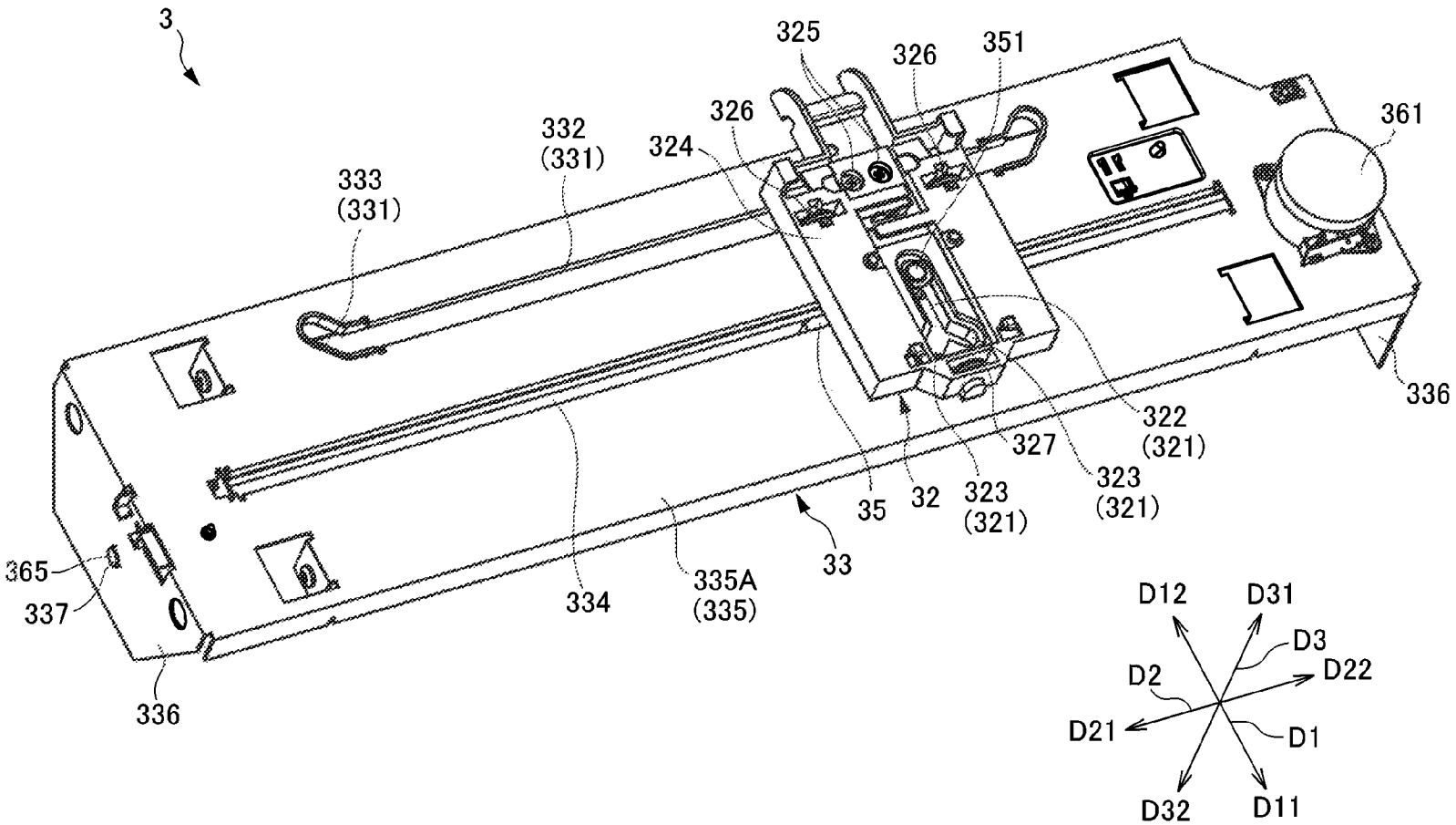
FIG. 3B is a view showing the movable table 32 in an exposed state, with the stapler 31 removed from FIG. 3A.
Figure 3C:
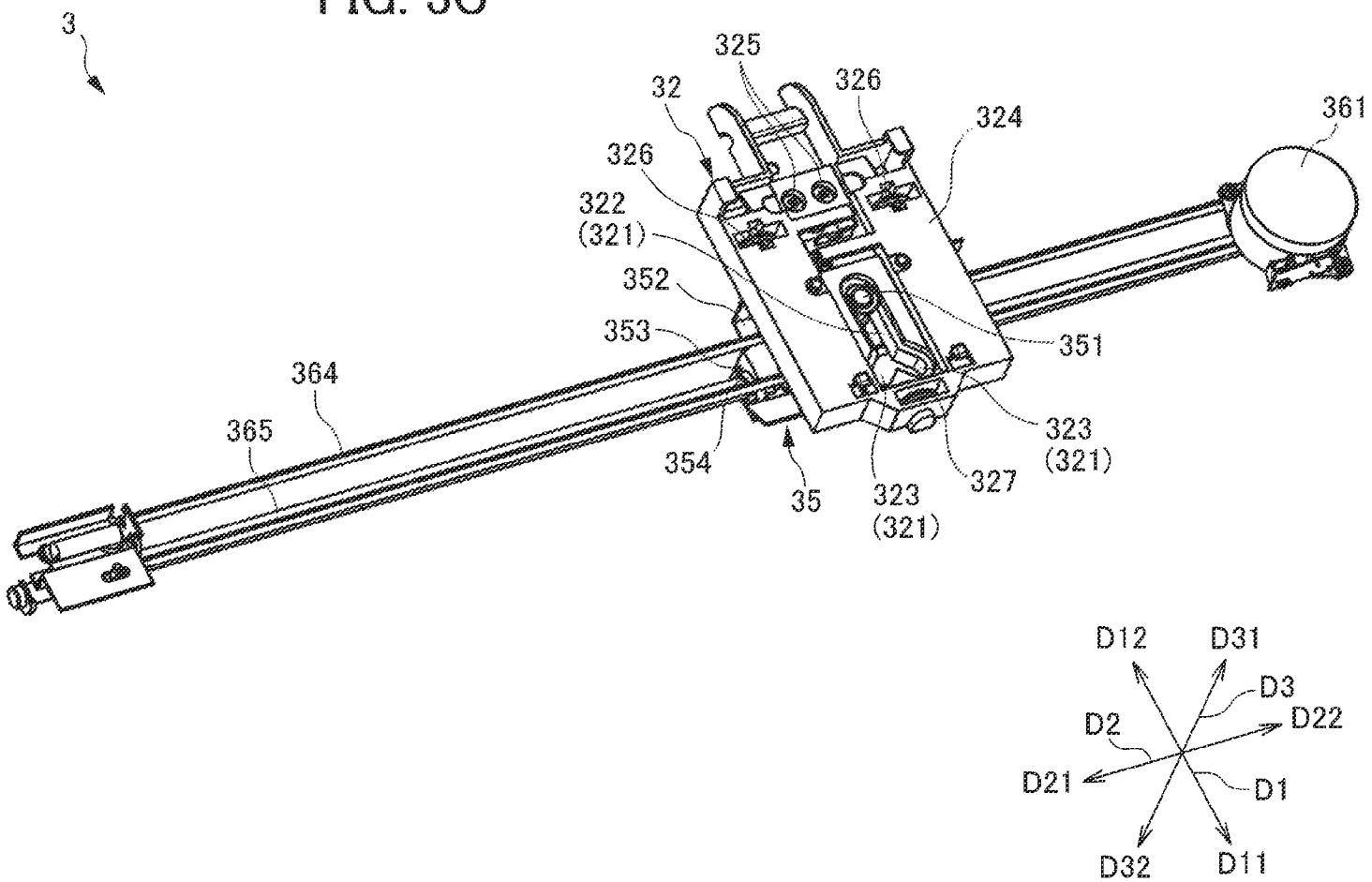
FIG. 3C is a view virtually showing a state with the base member 33 removed from FIG. 3B.
Figure 3D:
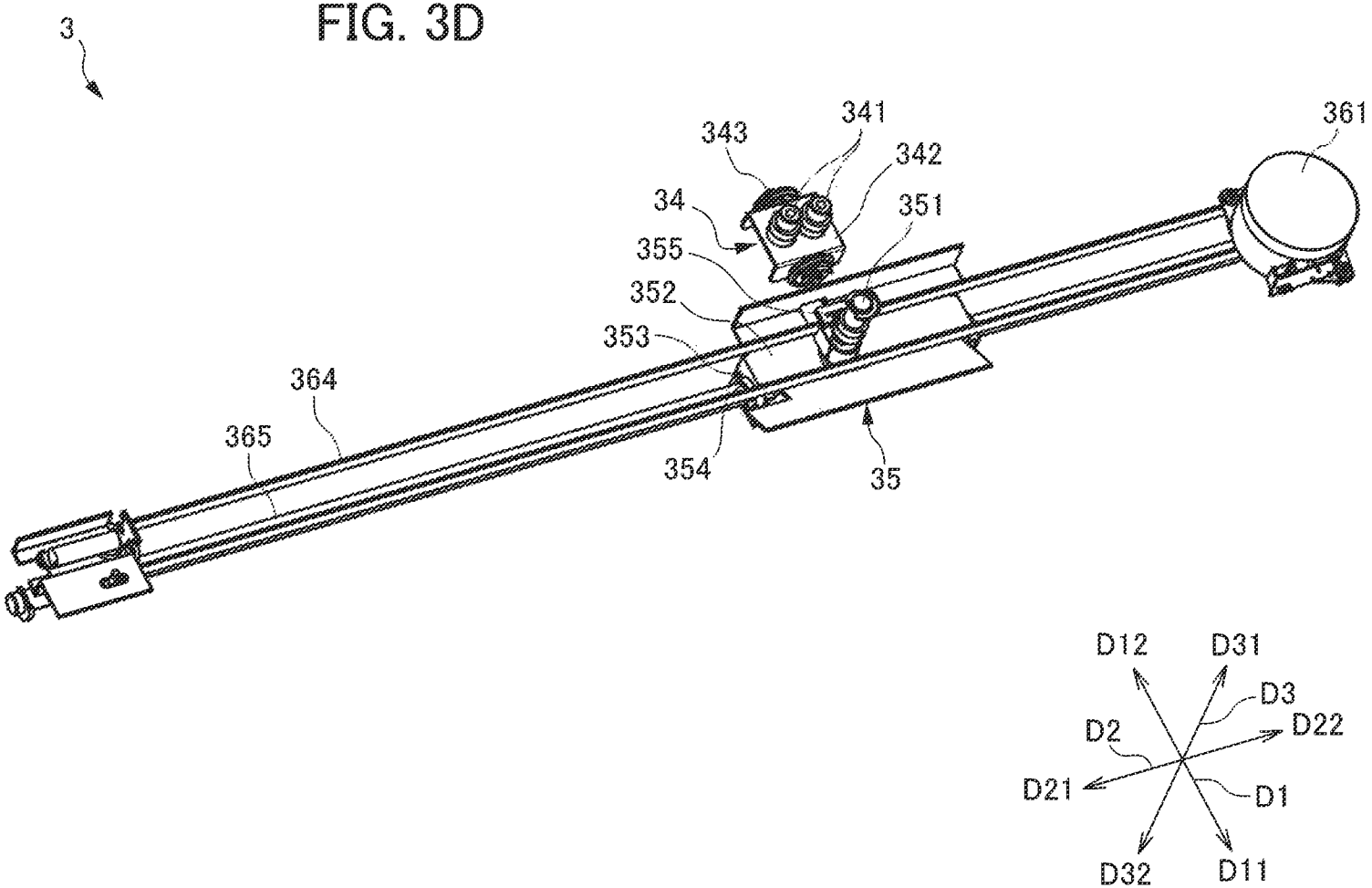
FIG. 3D is a view showing a state with the movable table 32 removed from FIG. 3C.
Figure 3E:
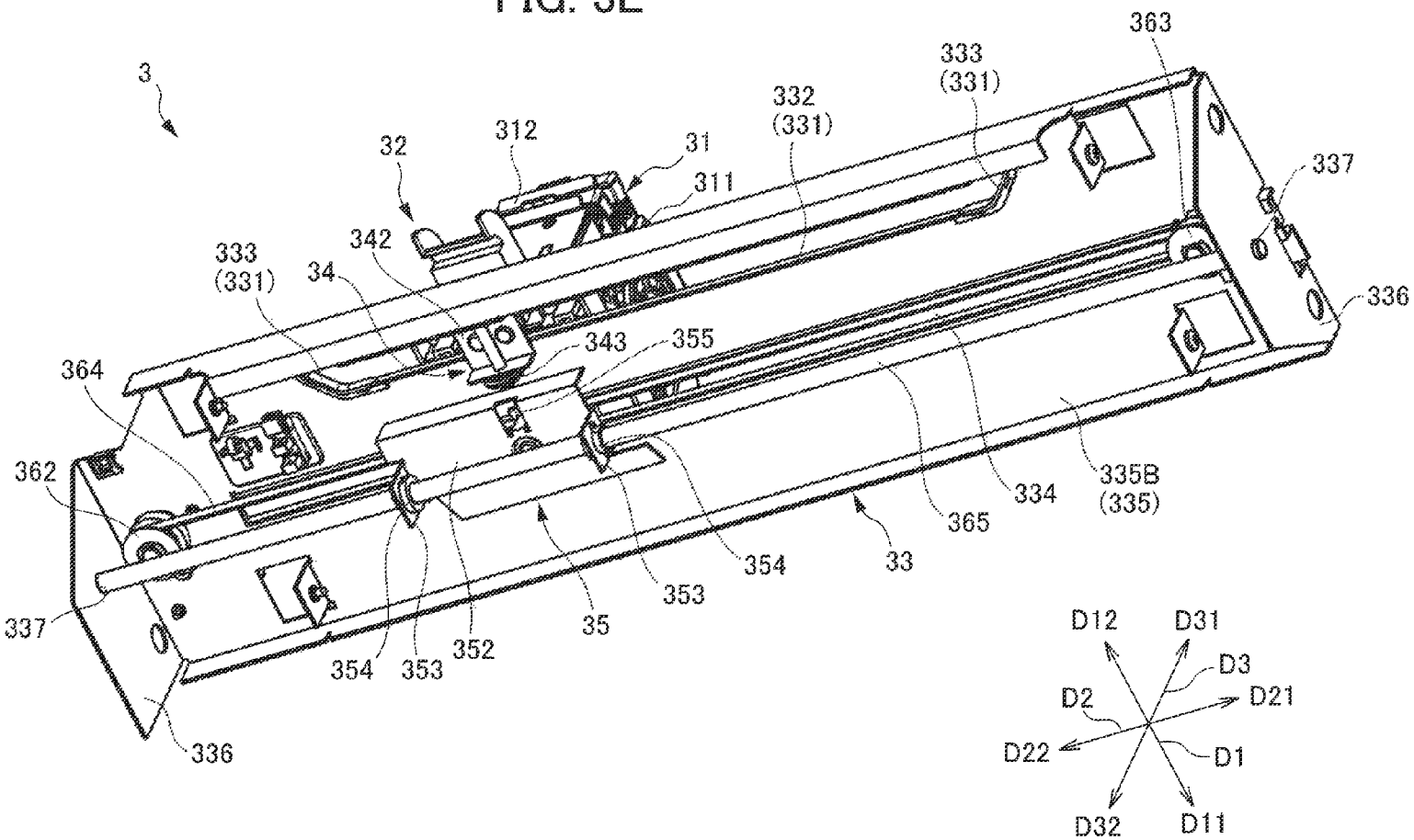
FIG. 3E is a perspective view of the state shown in FIG. 3A when viewed from a lower direction.

FIG. 3A is a perspective view showing a state where the stapler 31 of the staple processing unit 3 is not tilted. FIG. 3B is a view showing the movable table 32 to be exposed with the stapler 31 removed from FIG. 3A. FIG. 3C is a virtual view in which the base member 33 is removed from FIG. 3B. FIG. 3D is a view in which the movable table 32 is removed from FIG. 3C. FIG. 3E is a perspective view of the state shown in FIG. 3A when viewed from a lower direction.

Figure 4A:
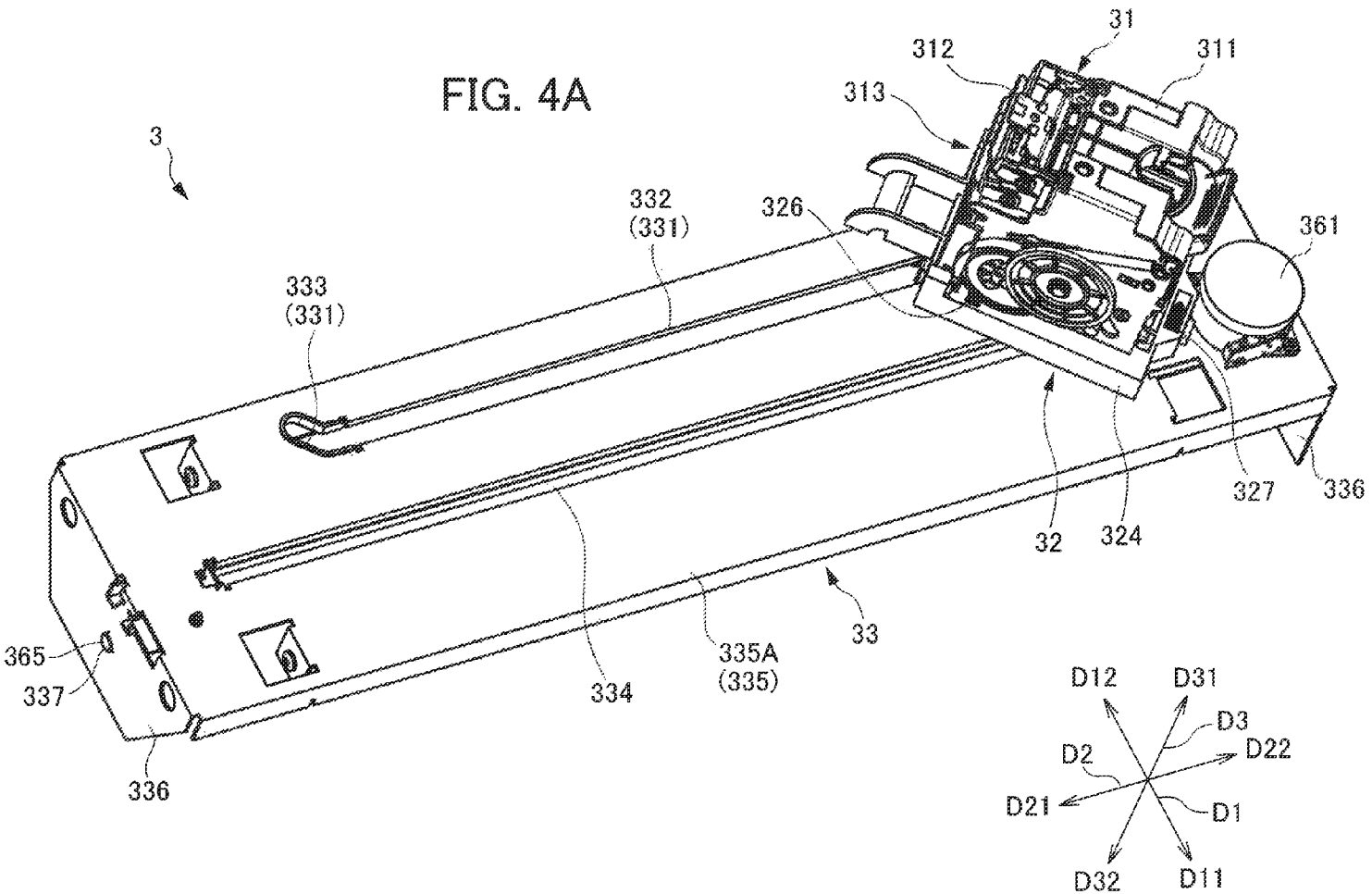
FIG. 4A is a perspective view of the stapler 31 in the staple processing unit 3 in a tilted state, at a backside of the sheet post-processing apparatus 1 shown in FIG. 1.
Figure 4B:
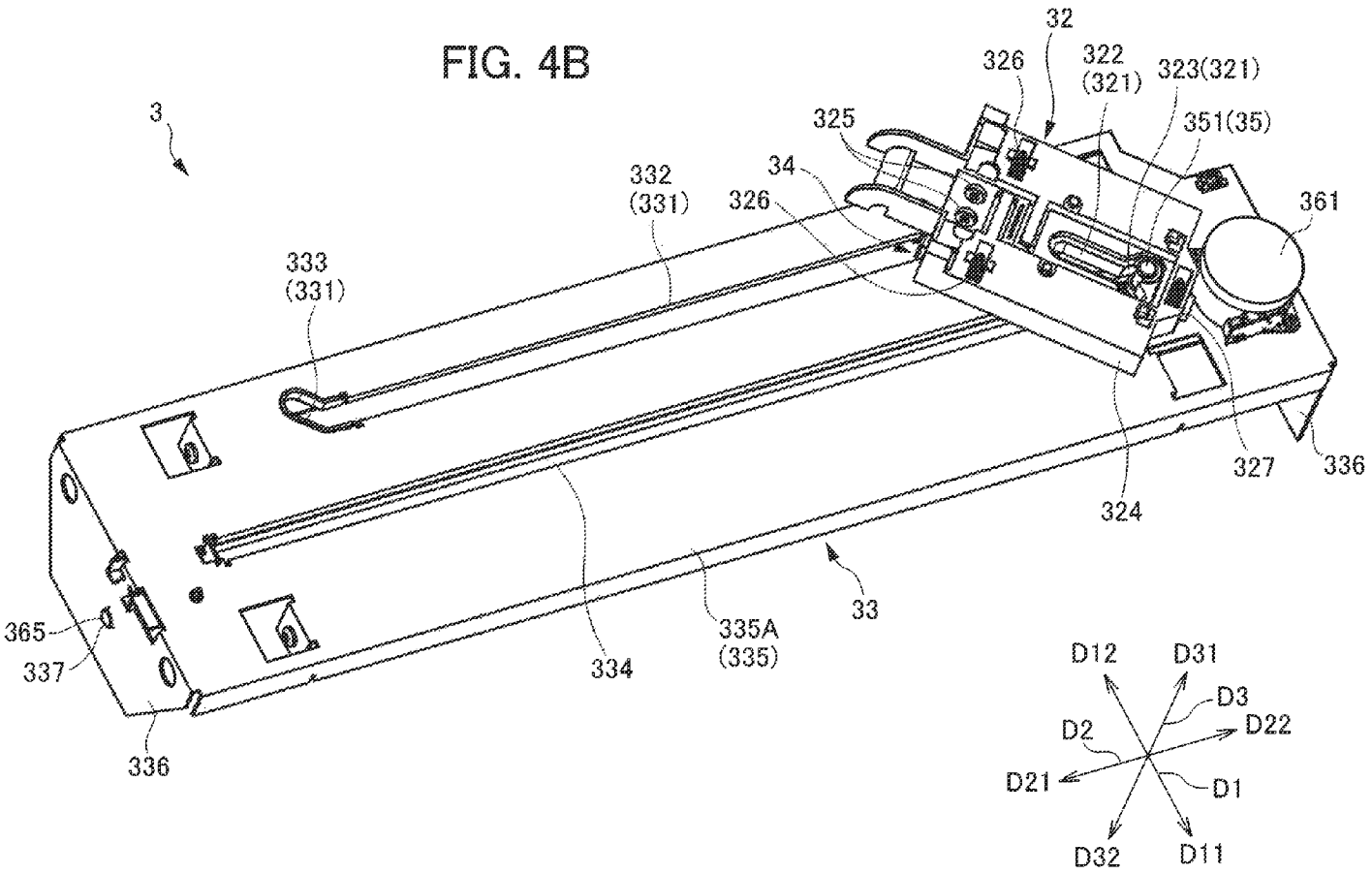
FIG. 4B is a view showing the movable table 32 in an exposed state, with the stapler 31 removed from FIG. 4A.
Figure 4C:
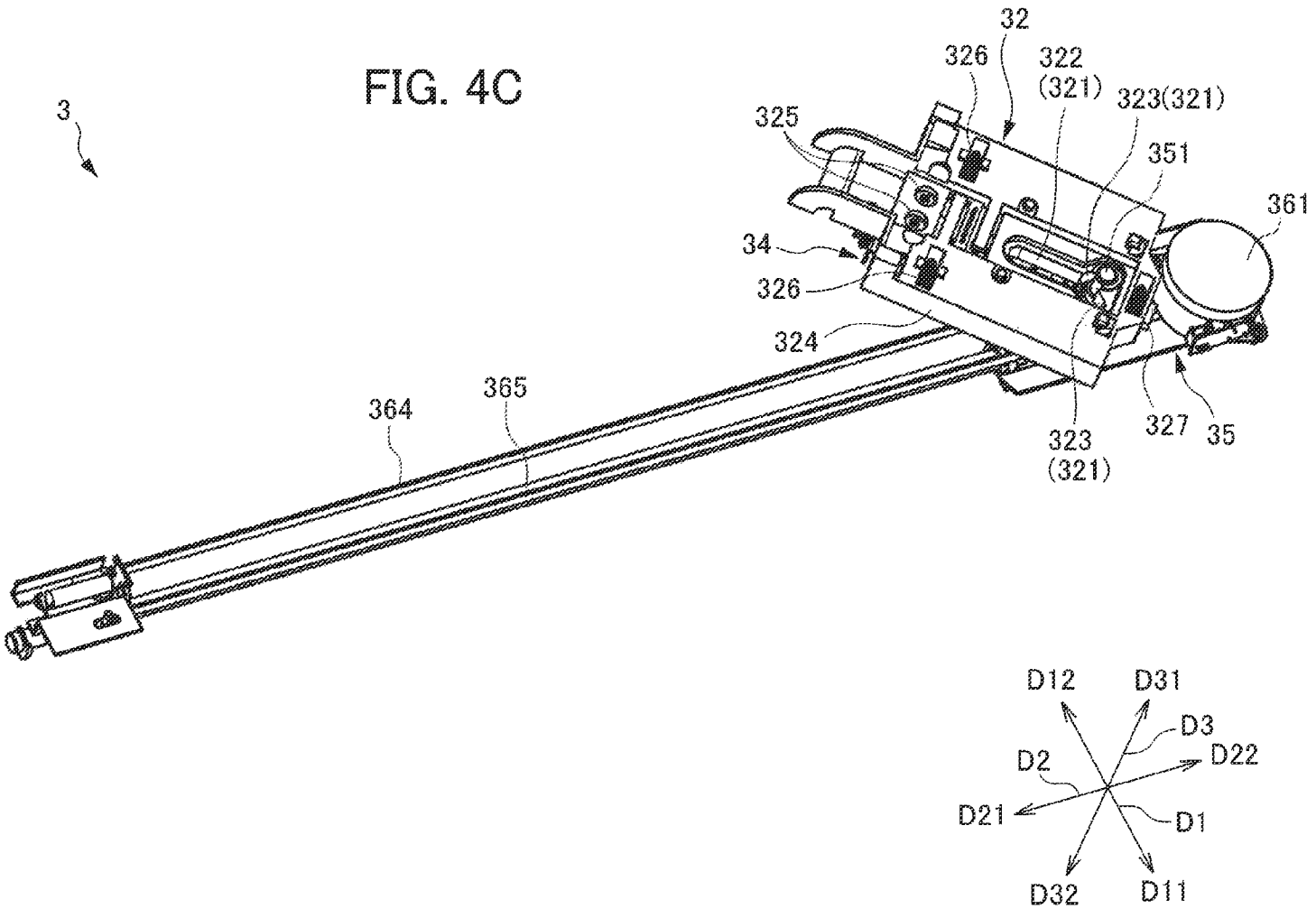
FIG. 4C is a view virtually showing a state with the base member 33 removed from FIG. 4B.
Figure 4D:
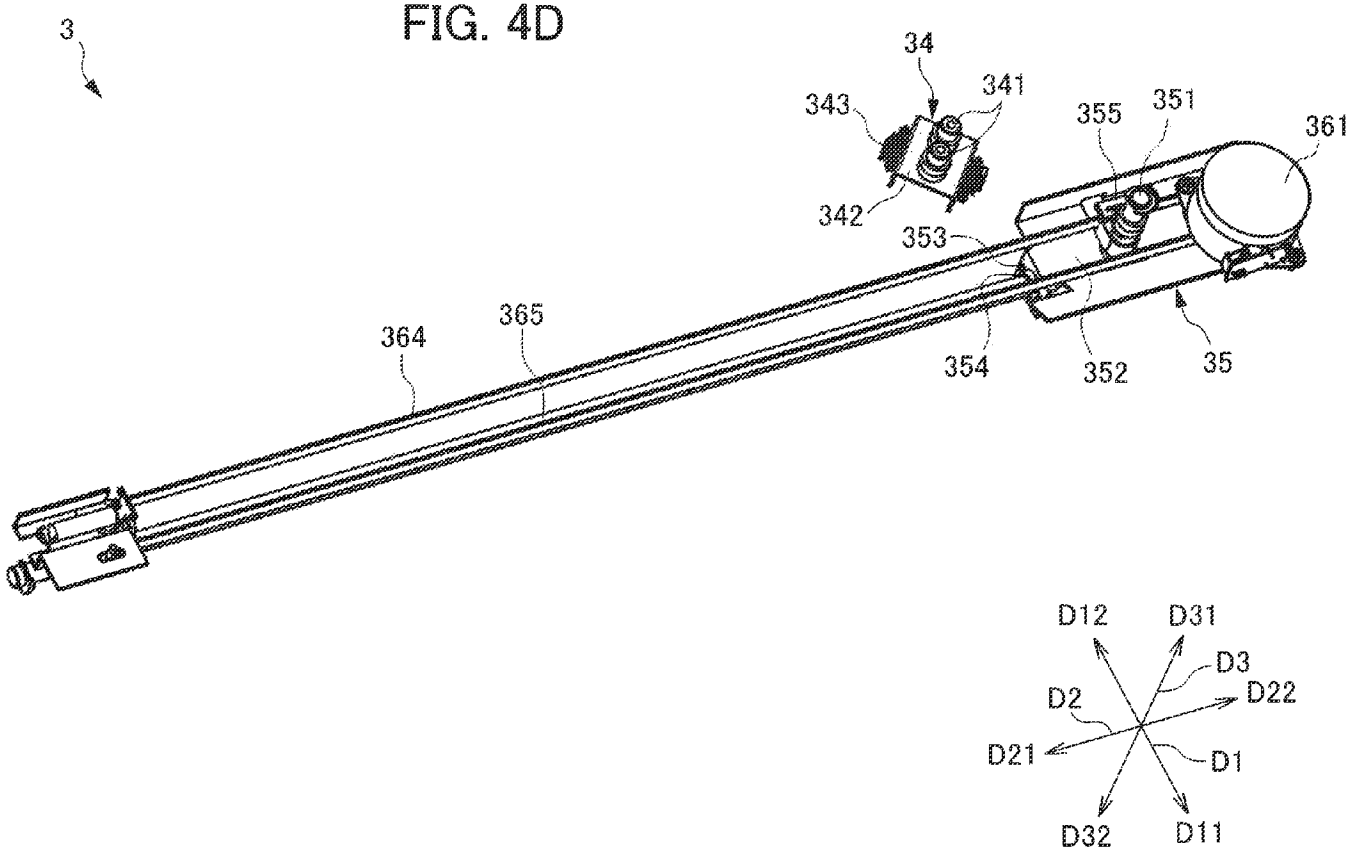
FIG. 4D is a view showing a state with the movable table 32 removed from FIG. 4C.
Figure 4E:
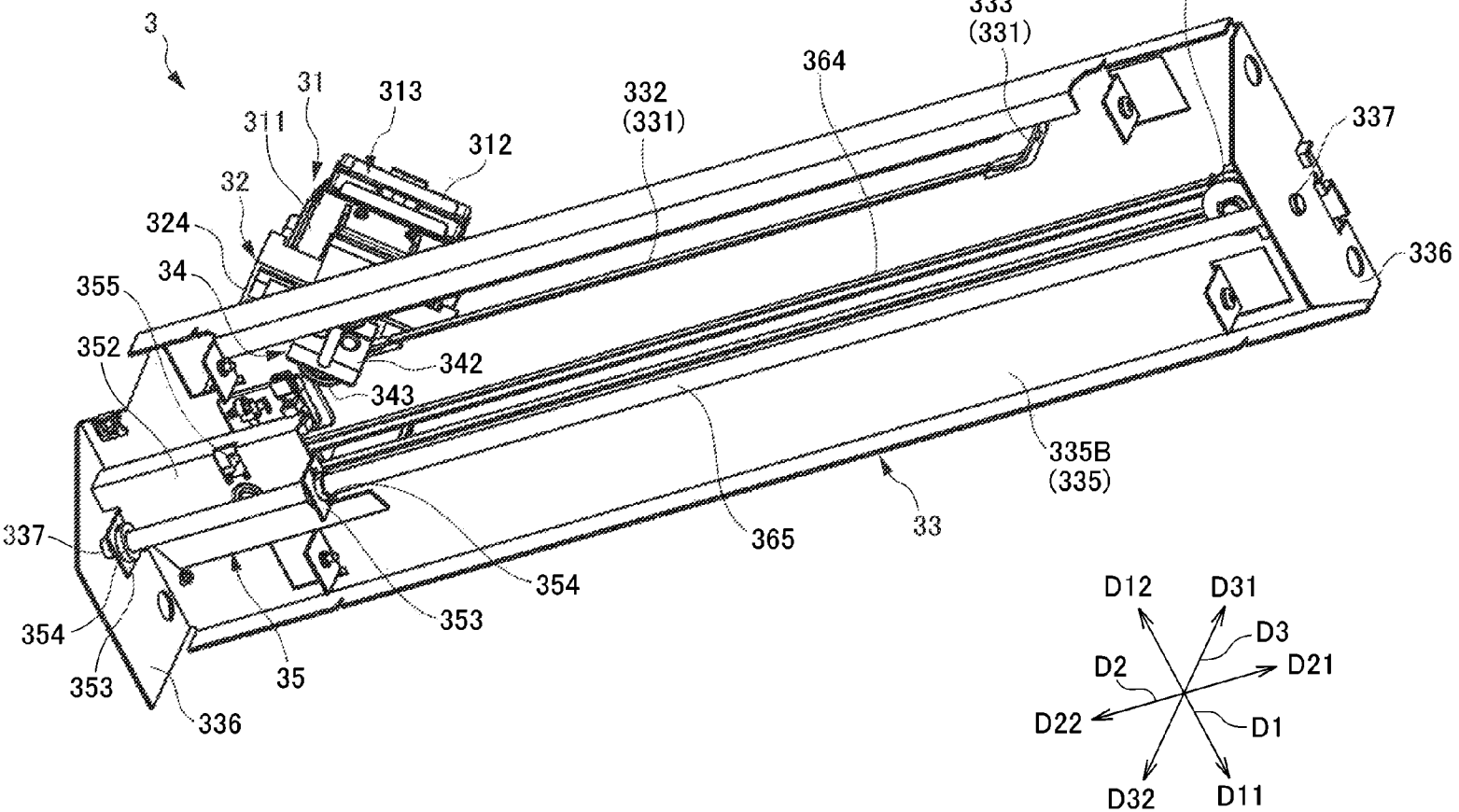
FIG. 4E is a perspective view of the state shown in FIG. 4A when viewed from a lower direction.
Figure 5:
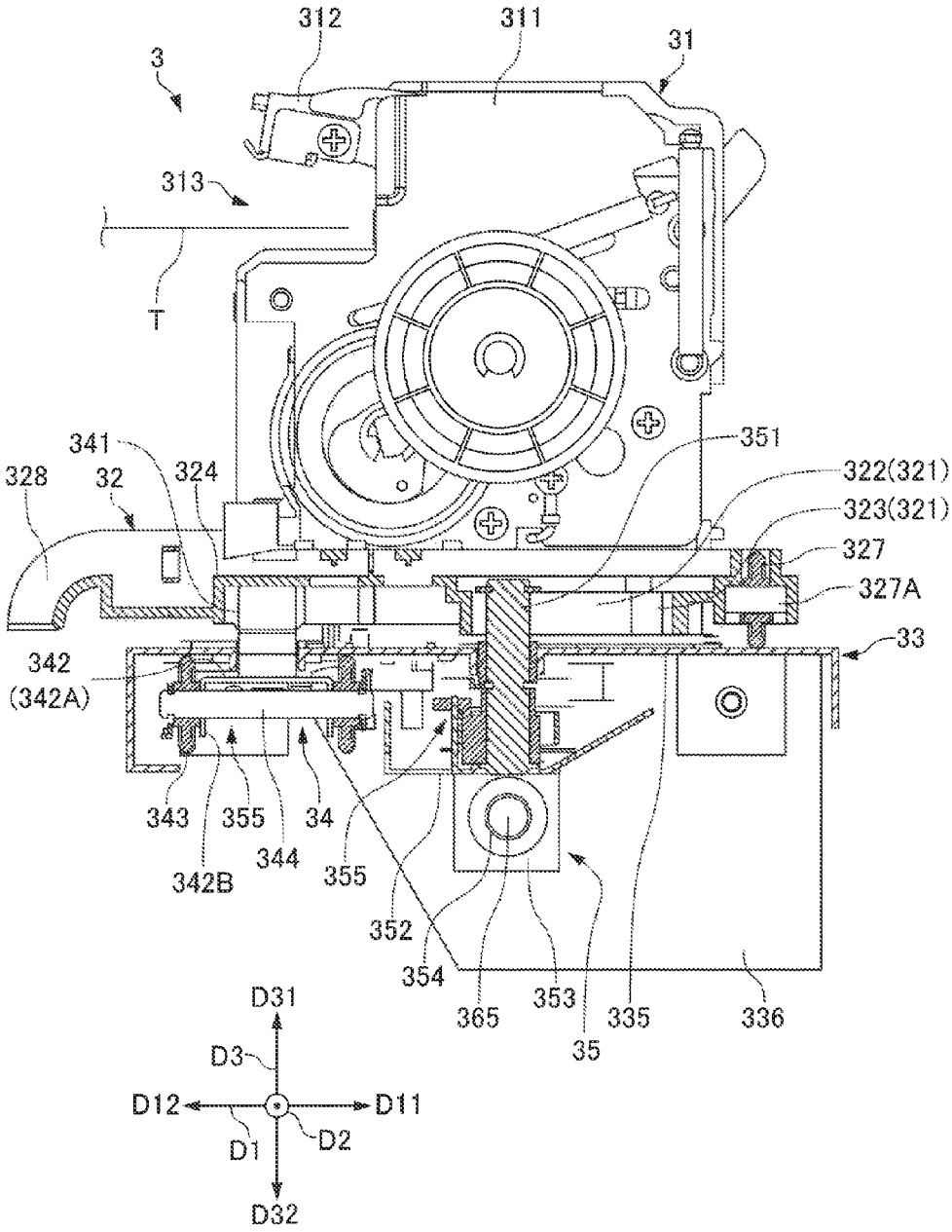
FIG. 5 is a view of the staple processing unit 3 in a state where the stapler 31 is not tilted, when viewed from the front side of the sheet post-processing apparatus 1, and is a sectional view of the bottom half thereof.
Figure 6:
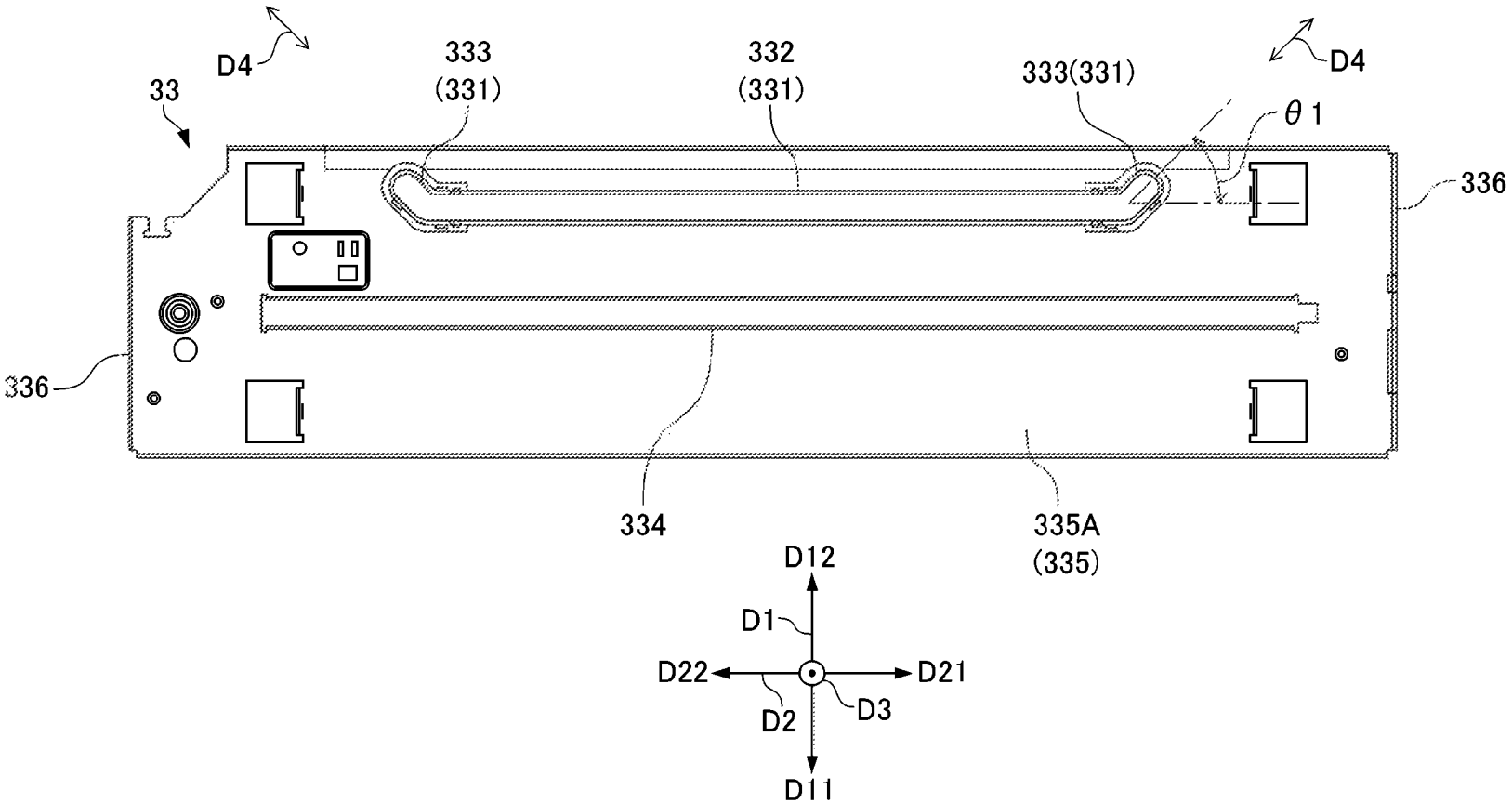
FIG. 6 is a view of the base member 33 when viewed from a lower direction.

FIG. 4A is a perspective view of the stapler 31 of the staple processing unit 3 in a tilted state, on a backside of the sheet post-processing apparatus 1 shown in FIG. 1. FIG. 4B is a view showing the movable table 32 to be exposed with the stapler 31 removed from FIG. 4A. FIG. 4C is a virtual view in which the base member 33 is removed from FIG. 4B. FIG. 4D is a view in which the movable table 32 is removed from FIG. 4C. FIG. 4E is a perspective view of the state shown in FIG. 4A when viewed from a lower direction. FIG. 5 is a view of the staple processing unit 3 when the stapler 31 is not tilted, when viewed from the front side of the sheet post-processing apparatus 1, and is a sectional view of the bottom half thereof. FIG. 6 is a view of the base member 33 when viewed from a lower direction.

Figure 7A:
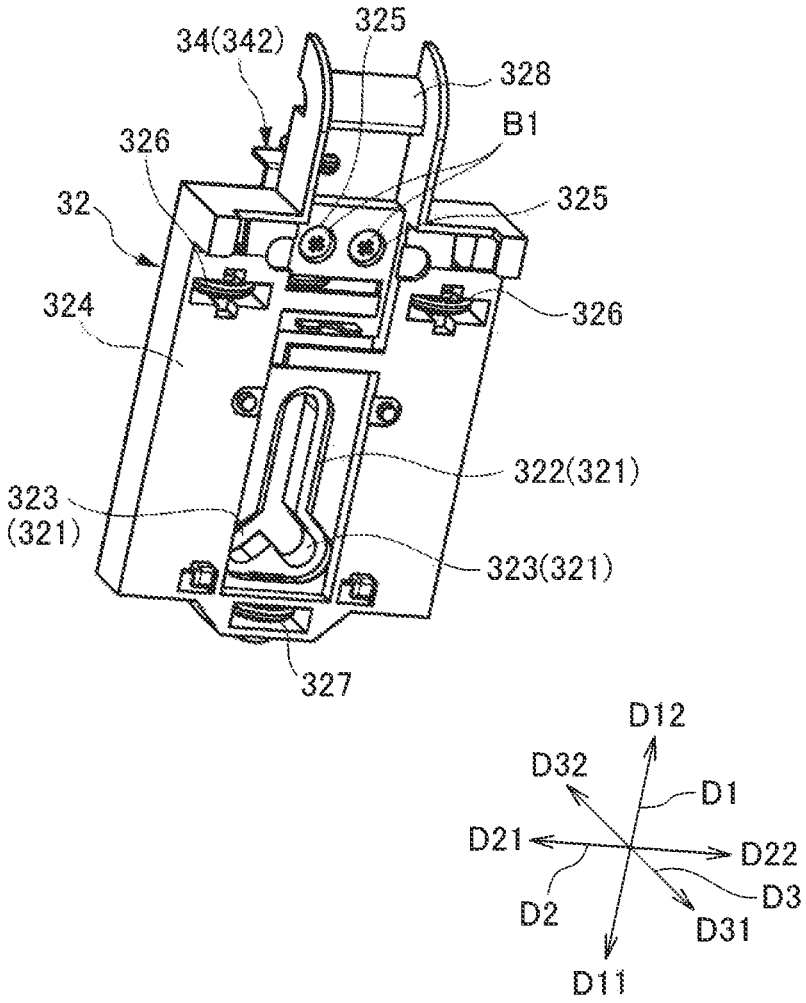
FIG. 7A is a perspective view from a top side of the movable table 32 interlocked with a first slider 34 including a guide groove engagement portions 341, while the base member 33 are not shown.
Figure 7B:
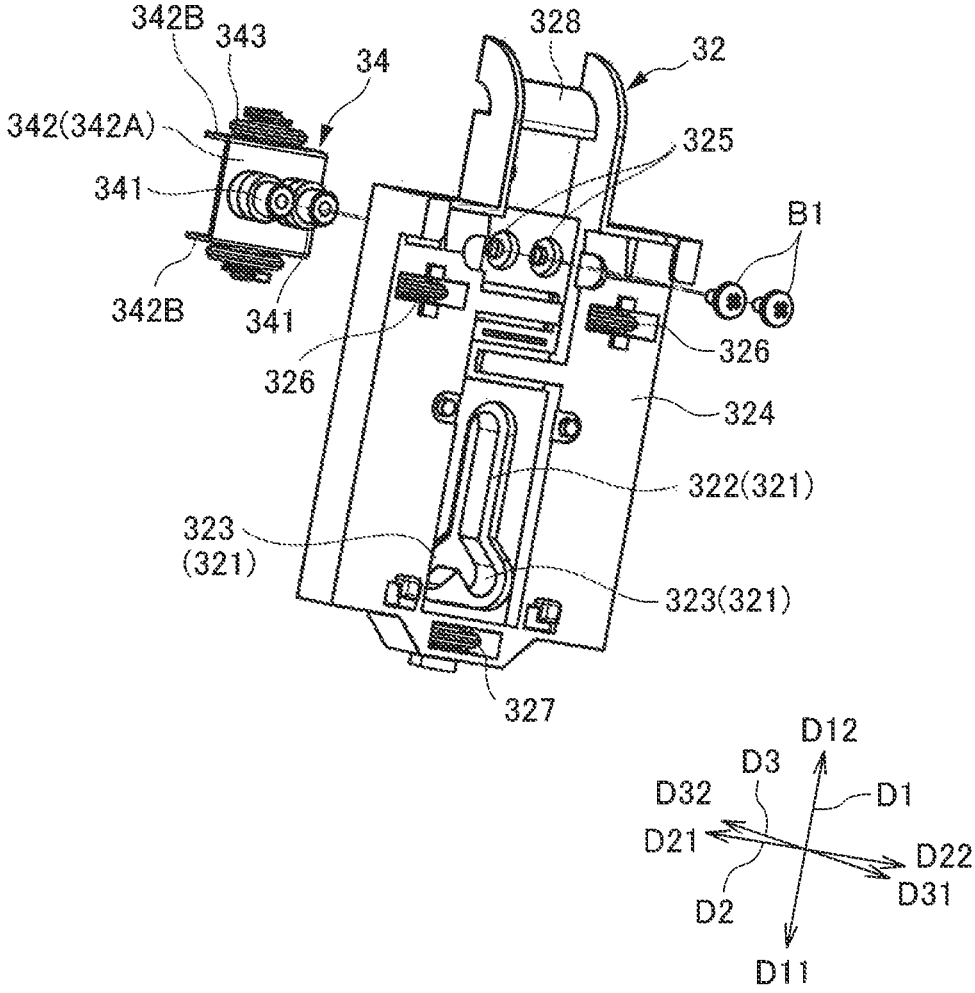
FIG. 7B is a perspective view differing from FIG. 7A by showing the movable table 32 separated from the first slider 34 including the guide groove engagement portions 341.
Figure 8A:
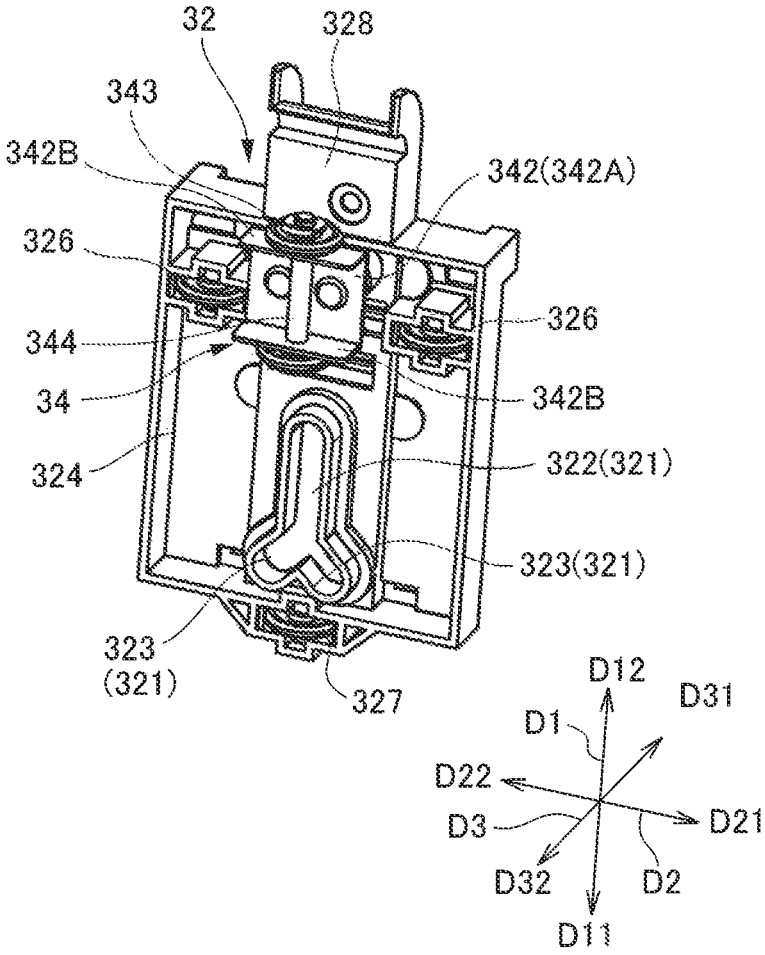
FIG. 8A is a perspective view of the state shown in FIG. 7A when viewed from a lower direction.
Figure 8B:
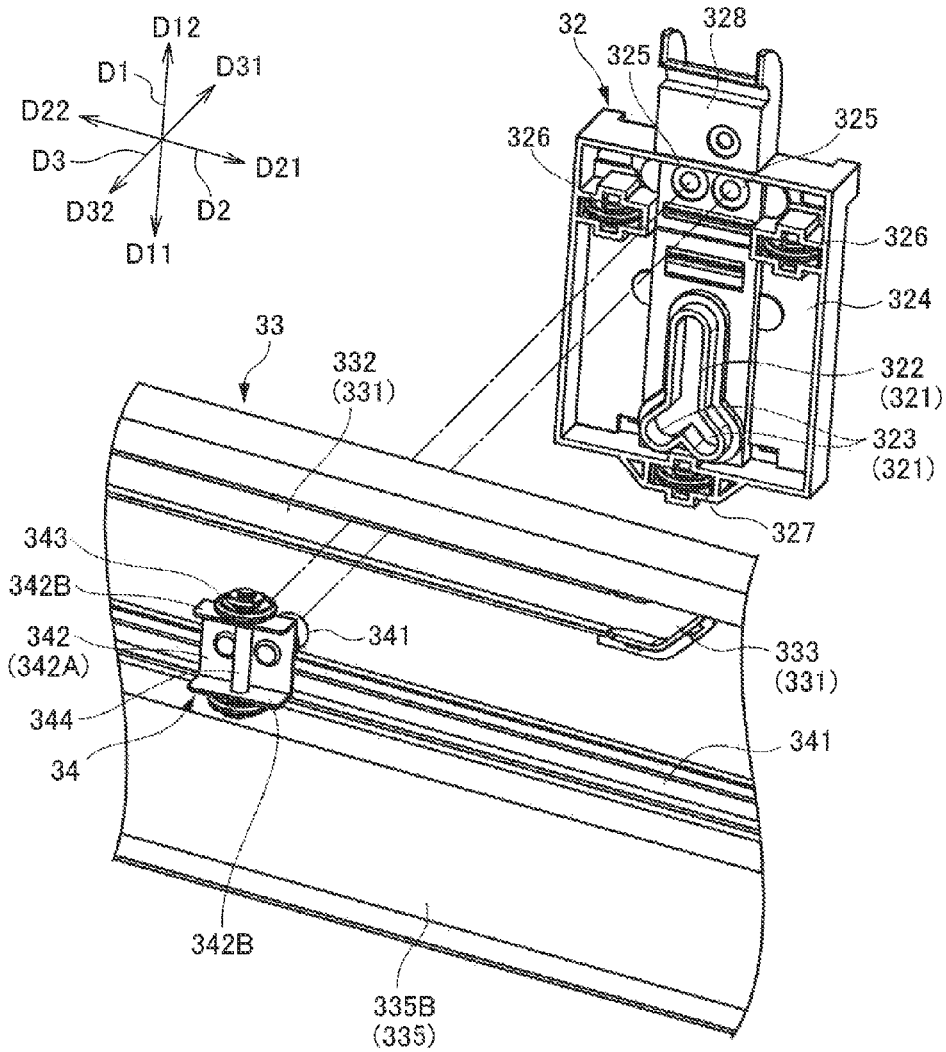
FIG. 8B is a perspective view of the state shown in FIG. 7B when viewed from a lower direction, showing the base member 33.
Figure 9:
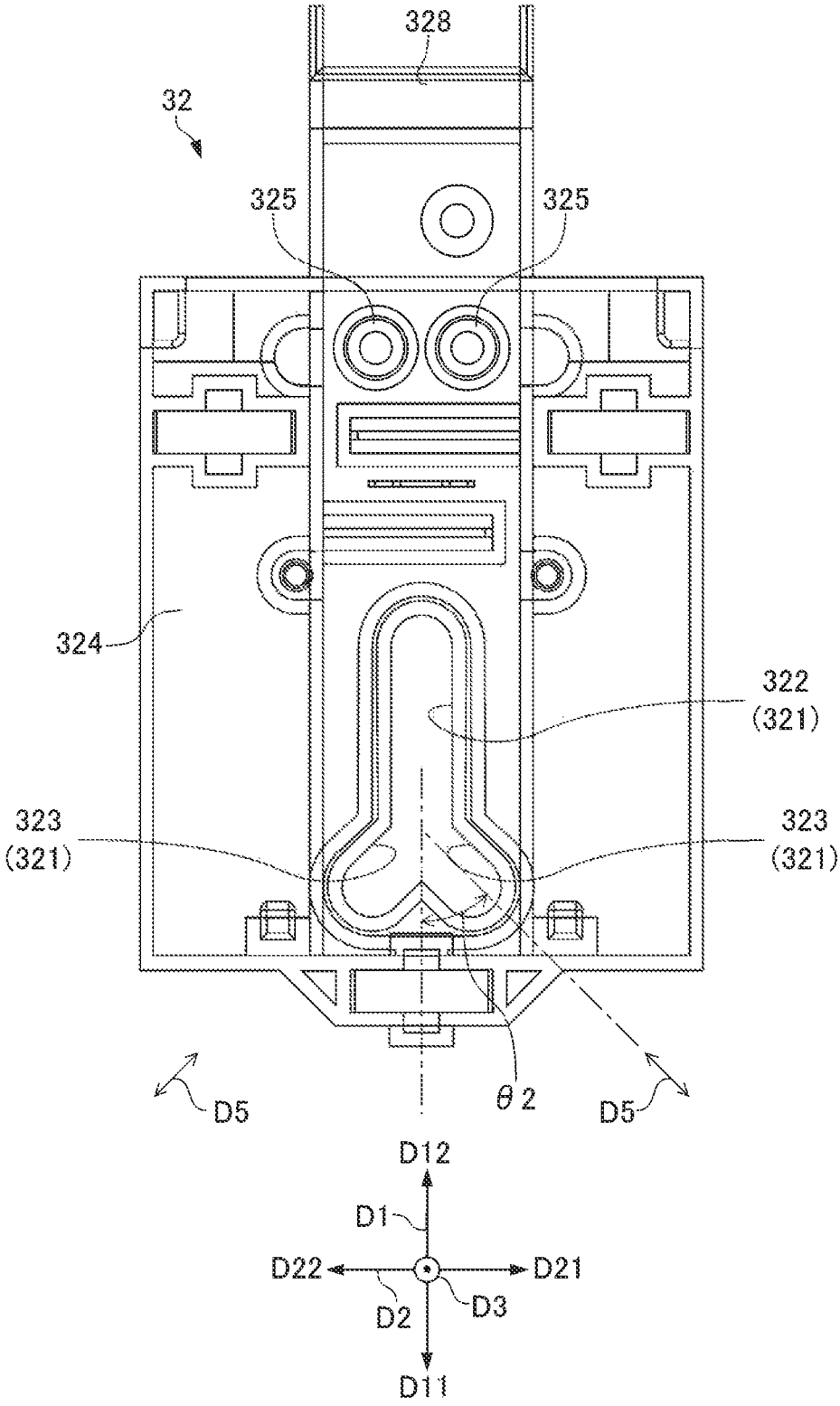
FIG. 9 is a view of the movable table 32 when viewed from a lower direction.
Figure 10A:
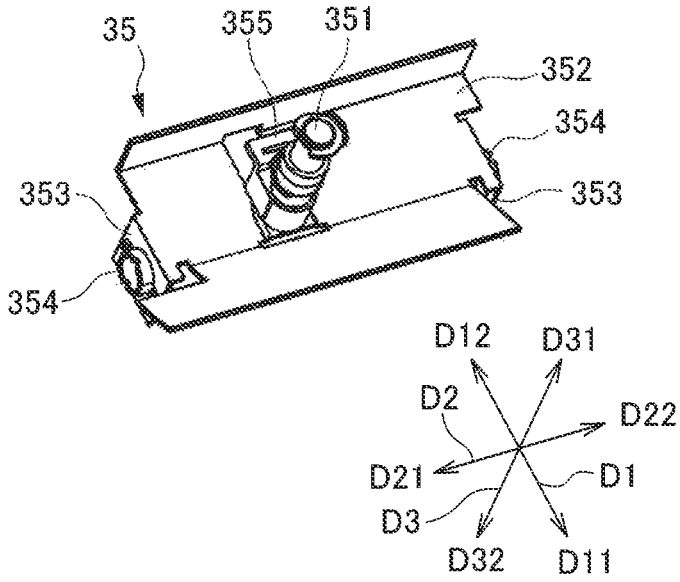
FIG. 10A is a perspective view showing a second slider 35 including a long hole engagement portion 351, when viewed from a top direction.
Figure 10B:
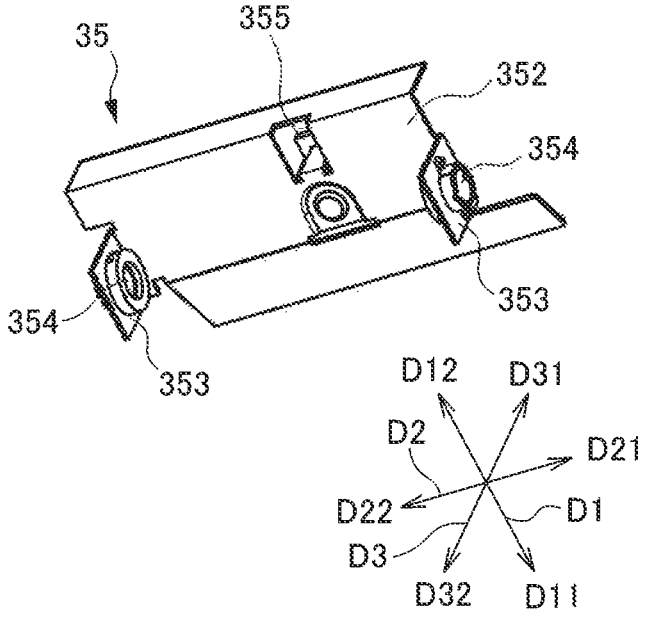
FIG. 10B is a perspective view of the second slider 35, when viewed from a lower direction.

FIG. 7A is a perspective view from a top side of the movable table 32 connected with a first slider 34 that includes guide groove engagement portions 341, while the base member 33 is not shown. FIG. 7B is a perspective view changed from FIG. 7A by showing the movable table 32 separated from the first slider 34 that includes the guide groove engagement portions 341. FIG. 8A is a perspective view of the state shown in FIG. 7A when viewed from a lower direction. FIG. 8B is a perspective view of the state shown in FIG. 7B when viewed from a lower direction, with the base member 33 shown. FIG. 9 is a view of the movable table 32 when viewed from a lower direction. FIG. 10A is a perspective view showing a second slider 35 that includes a long hole engagement portion 351, when viewed from an upper direction. FIG. 10B is a perspective view of the second slider 35, when viewed from a lower direction.

As shown in FIG. 1, the staple processing unit 3 according to this embodiment of the present invention is positioned at an upper portion of the housing 11 in the sheet post-processing apparatus 1. The staple processing unit 3 is disposed downstream of the first path L1. A stack of sheets T (see FIG. 5) that is prepared by stacking processing performed for a plurality of sheets is guided into the staple processing unit 3. More specifically, the staple processing unit 3 implements the stapling process by driving a staple SP (see FIG. 12) into the stack of sheets T. When a user selects a stapling process, the staple processing unit 3 implements the stapling process on the stack of sheets T. The stapled stack of sheets T is ejected to the main ejection tray 51 disposed at an upper portion on one side surface of the housing 11 of the sheet post-processing apparatus 1.

For the sake of convenience, the term "sheet" in the explanation below also includes the meaning of a stack of sheets. A direction that sheets T are conveyed to the staple processing unit 3 or from the staple processing unit 3 is called a sheet-conveyance direction D1. Of the sheet-conveyance direction D1, a direction approaching the staple processing unit 3 is called "conveyance downstream direction D11;" a direction moving away from the staple processing unit 3 is called "conveyance upstream direction D12."

A direction perpendicular to the sheet-conveyance direction D1 (specifically, a width direction of a sheet T perpendicular to the sheet-conveyance direction D1) is called "perpendicular direction D2." Of the perpendicular direction D2, a front side of the sheet post-processing apparatus 1 (a front side of the paper surface in FIG. 1) is called "perpendicular front direction D21;" a backside of the sheet post-processing apparatus 1 (a backside of the paper surface in FIG. 1) is called "perpendicular back direction D22."

Directions perpendicular to the sheet-conveyance direction D1 and the perpendicular direction D2 (directions perpendicular to a D1-D2 plane, or a thickness direction of the sheet T) are called "upward and downward directions D3." Of the upward and downward directions D3, an upward direction is called "upward direction D31" and a downward direction is called "downward direction D32."

As shown in FIGS. 2A to 10B, the staple processing unit 3 includes the stapler 31 as a stapling unit, the movable table 32 including a long hole portion 321, the base member 33 including a guide groove 331, the first slider 34 including guide groove engagement portions 341, and the second slider 35 including a long hole engagement portion 351. Also, in the staple processing unit 3, the movable table rectilinearly driving portion, the movable table rotationally driving portion, and the tilt retention portion are composed of these members. The movable table rectilinearly driving portion causes the movable table 32 to rectilinearly move in the perpendicular direction D2. The movable table rotationally driving portion causes the movable table 32 to rotate such that the stapler 31 is tilted to a position to drive a staple at a predetermined angle with respect to the sheet-conveyance direction D1. The tilt retention portion mechanically holds the movable table 32 to maintain the stapler 31 tilted. The movable table rectilinearly driving portion, the movable table rotationally driving portion and the tilt retention portion will be described in detail later.

A sheet feeding mechanism, not shown, conveys a sheet T to be stapled to the stapler 31. The sheet-conveyance direction D1 of the sheet T is oblique with respect to the upward and downward directions (upward and downward directions in FIG. 1) of the sheet post-processing apparatus 1. The conveyance downstream direction D11 is oriented a lower right-hand side of the sheet post-processing apparatus 1.

The stapler 31 drives a staple SP (see FIG. 12) into a stack of sheets T that is obtained through stacking processing performed by the staple processing unit 3. As shown in FIG. 5, the stapler 31 includes a stapler main unit 311 including a clincher, a stitcher 312, and a sheet insertion recess portion 313. The stapler 31 interposes a stack of sheets T, which is inserted into the sheet insertion recess portion 313, between the stitcher 312 and the clincher. In this manner, the stapler 31 drives a staple (see FIG. 12) into the stack of sheets T. The stapler 31 of this embodiment drives a staple SP near a corner of the stack of sheets T (see FIG. 12), such that the staple is tilted at a predetermined angle in the plane D1-D2 with respect to the sheet conveyance direction D1 of the stack of sheets T.

As shown in FIGS. 2A to 6, the base member 33 supports movement of the stapler 31 in the perpendicular direction D2 via the movable table 32, as will be described later. The base member 33 is mainly composed of sheet metal. The base member 33 includes a substantially rectangular main surface portion 335 and a pair of hanging portions 336, 336. The main surface portion 335 expands over the D1-D2 plane; the length of perpendicular direction D2 is longer than that of the sheet-conveyance direction D1.

A top surface 335A of the main surface portion 335 is tilted with respect to a vertical direction (the upward and downward directions in FIG. 1) of the sheet post-processing apparatus 1. The pair of hanging portions 336, 336 extends toward the downward direction D32 from ends of the main surface 335, the ends lying in the perpendicular front direction D21 and the perpendicular back direction D22, respectively.

The main surface portion 335 has the top surface 335A facing in the upward direction D31, and a lower surface 335B facing in the downward direction D32.

A guide groove 331 and a travel groove 334 are disposed in the main surface portion 335.

The guide groove engagement portions 341 of the first slider 34, to be described later, are inserted into the guide groove 331, passing through in the upward and downward directions D3. The guide groove 331 includes a perpendicular groove 332 and tilted grooves 333.

The perpendicular groove 332 is a groove extends along the perpendicular direction D2. This groove is positioned in the main surface portion 335 on a side of the conveyance upstream direction D12.

Each tilted groove 333 extends along a first tilted direction (tilted direction) D4 (see FIG. 6) that is set at a predetermined angle with respect to the sheet-conveyance direction D1. For example, a first tilted angle e1 (see FIG. 6) by which the first tilted direction (tilted direction) D4 is defined with respect to the perpendicular direction D2 is between 15 degrees and 45 degrees. When viewed in the upward and downward directions D3, the tilted grooves 333 extend in the first tilted direction D4 and are line-symmetrical with each other.

The travel groove 334 is extends along the perpendicular direction D2. The travel groove 334 is disposed substantially in the center portion of the main surface portion 335 with respect to the sheet-conveyance direction D1. The travel groove 334 extends along the perpendicular direction D2 longer than the guide groove 331.

The long hole engagement portion 351 of the second slider 35, to be described later, is inserted into the guide groove 334, passing through in the upward and downward directions D3.

As shown in FIGS. 7A to 9, the movable table 32 extends in the D1-D2 plane. The stapler 31 is mounted onto and supported by the movable table 32. The movable table 32 moves in unison with the stapler 31 rectilinearly with respect to the base member 33 along the perpendicular direction D2.

The movable table 32 and the first slider 34 including the guide groove engagement portions 341, to be described later, rotate around a hypothetical rotational axis that extends in the upward and downward directions D3, as will be described later. Unless specified otherwise, explanations of the movable table 32 will be given according to a base condition: a direction in which the guide groove engagement portions 341 are disposed matches a direction in which the perpendicular groove 332 of the guide groove 331 extends (hereinafter, also called a matching state).

The movable table 32 includes a substantially rectangular base portion 324 and an extending portion 328, when viewed in the upward and downward directions D3. The extending portion 328 is a part that extends from an end of the base portion 324 in the conveyance upstream direction D12.

The base portion 324 includes a pair of wheels 326, 326 and a wheel 327.

The wheels 326, 326 are disposed in the base portion 324 on a side of the conveyance upstream direction D12, while the wheels 326, 326 are apart from each other in the perpendicular direction D2. More specifically, through holes (without symbols) that pass through in the upward and downward directions D3 are provided in the base portion 324. The wheels 326, 326 connected to shafts (without symbols) are positioned in these through holes. The shafts are supported by the base portion 324. Accordingly, the wheels 326, 326 while projecting in the downward direction D32 rotate freely on the base portion 324.

Similarly, the wheel 327 is positioned in a central portion of the base portion 324 with respect to the perpendicular direction D2 and on a side of the conveyance downstream direction D11. More specifically, a through hole (without a reference numeral) is provided in the base portion 324 that passes through in the upward and downward directions D3. The wheel 327 connected to a shaft 327A (see FIG. 5) is positioned in the through hole. The shaft 327A is supported by the base portion 324. Accordingly, the wheel 327 rotates freely on the base portion 324, projecting toward the downward direction D32. The wheels 326 and 327 rotate in contact with the top surface portion 335A of the main surface 335 of the base member 33. In this manner, the movable table 32 is smoothly movable on the D1-D2 plane that includes a direction in which the guide groove 331 extends, on a side of the top surface 335A of the main surface portion 335 of the base member 33.

A long hole portion 321 is provided in the base portion 324 on a side of the base member 33. The long hole portion 321 includes a long conveyance direction hole 322 and a pair of long tilting direction holes 323, 323.

The long conveyance direction hole 322 extends in the sheet-conveyance direction D1 and penetrates in the upward and downward directions D3, in a matching state where a direction in which the guide groove engagement portions 341 are arranged matches a direction in which the perpendicular groove 332 of the guide groove 331 extends.

Each long tilting direction hole 323 continues from the long conveyance direction hole 322, and extends in a second tilted direction D5 (see FIG. 9) that is oblique to the sheet-conveyance direction D1 during the matching state. For example, the second tilted angle θ2 by which the second tilted direction D5 is defined with respect to the sheet-conveyance direction D1 is between 15 degrees and 45 degrees. Each long tilting direction hole 323 is a through hole passing through in the upward and downward directions D3.

The long conveyance direction hole 322 and the pair of long tilting direction holes 323, 323 are connected with each other to extend in three directions when viewed in the upward and downward directions D3.

A pair of through holes 325, 325 is disposed in the base portion 324 on a side of the conveyance upstream direction D12. The through holes 325, 325 are disposed away from each other in the perpendicular direction D2 and pass through in the upward and downward directions D3. The guide groove engagement portions 341 of the first slider 34, to be described later, abut peripheries of the through holes 325, 325 on a side of the downward direction D32 in the base portion 324. Screws B1 (see FIG. 7B) are inserted in the through holes 325, 325. These screws B1 connect (fasten) the base portion 324 on a side of the downward direction D32 and the guide groove engagement portions 341.

The first slider 34 sandwiches the base portion 33 with the movable table 32 via the guide groove 331 of the base member 33. Unless specified otherwise, explanations of the first slider 34 are based on a state where a direction in which the guide groove engagement portions 341, to be described later, is arranged matches a direction in which the perpendicular groove 332 of the guide groove 331 extends.

The first slider 34 is freely movable by being guided by the guide groove 331 along a direction in which the guide groove 331 extends. Specifically, the first slider 34 is freely movable by being guided by the guide groove 331 along the direction in which the guide groove 331 extends, while the guide groove engagement portions 341 are inserted in the guide groove 331. More specifically, the first slider 34 is freely movable not only in the first tilted direction D4 along the tilted groove 333 of the guide groove 331, but also in the perpendicular direction D2 along the perpendicular groove 332 of the guide groove 331.

As shown in FIGS. 5 and 7B-8B, the first slider 34 includes a first slider unit 342, the guide groove engagement portions 341, wheels 343, and a shaft 344.

The first slider unit 342 is substantially shaped like a n, when viewed in the perpendicular direction D2. The first slider unit 342 has a first portion 342A that extends along the D1-D2 plane, and a pair of second portions 342B, 342B that extends along the D2-D3 plane. The pair of second portions 342B, 342B, is disposed away from each other in the sheet-conveyance direction D1 and extends from both ends of the first portion 342A toward the downward direction D32.

The shaft 344 is supported by the pair of second portions 342B, 342B. In this manner, the wheels 343 are rotatably supported by the first slider unit 342 via the shaft 344. The wheels 343 project more outward in the upward direction D31 than the first portion 342A, and rotate in contact with a bottom surface 335B of the main surface portion 335 of the base member 33. Accordingly, the first slider 34 is smoothly movable along the D1-D2 plane including a direction where the guide groove 331 extends, on a side of the bottom surface 335B of the main surface portion 335 of the base member 33.

Each guide groove engagement portion 341 is substantially shaped like a cylinder that extends from the first slider unit 342 toward the upward direction D31. There are two guide groove engagement portions 341 arranged along the direction in which the guide groove 331 extends. The direction in which the guide groove 331 extends is: the perpendicular direction D2 in the perpendicular groove 332; and the first tilted direction D4 in each tilted groove 333. The guide groove engagement portions 341 are inserted into the guide groove 331 to be connected to the movable table 32 on a side of the base member 33.

As shown in FIGS. 5, and 10A and 10B, the second slider 35 includes a second slider unit 352, the long hole engagement portion 351, a pair of hanging portions 353, 353, a pair of sliding holes 354, 354, and a linking portion 355.

The second slider 35 slides to move along a sliding shaft 365, to be described later, and an endless belt 364 in the perpendicular direction D2.

The second slider unit 352 extends substantially along the D1-D2 plane.

The long hole engagement portion 351 is substantially shaped like a cylinder that extends from the second slider unit 352 in the upward direction D31. The long hole engagement portion 351 is inserted into the long hole portion 321 to engage with the long hole portion 321. The long hole engagement portion 351 is exposed on a side of the top surface 335A of the main surface portion 335 of the base member 33, passing through the travel groove 334 of the base member 33. The exposed long hole engagement portion 351 engages with the long hole portion 321 of the movable table 32.

The entire second slider 35 is movable in the perpendicular direction D2 with respect to the base member 33, so that the long hole engagement portion 351 is movable in the perpendicular direction D2 with respect to the base member 33.

The pair of hanging portions 353, 353 projects from ends of the second slider 352 in the perpendicular front direction D21 and perpendicular back direction D22, respectively, toward the downward direction D32.

Each sliding hole 354 is a hole provided in each hanging portion 353 to pass through in the perpendicular direction D2. A slide shaft 365 is inserted into the pair of sliding holes 354,354 traversing these holes.

The linking portion 355 links the second slider unit 352 on a side of the upward direction D31 and the endless belt 364.

In addition to the items described above, descriptions will now be given of items related to movement performed by the movable table rectilinearly driving portion and rotation performed by the movable table rotationally driving portion such as: a motor 361, a first pulley 362, a second pulley 363, the endless belt 364, and the slide shaft 365.

As shown in FIG. 2A and others, the motor 361 is an actuator that rotationally drives the first pulley 362 via a shaft (not shown) and the like. The motor 361 is secured to the top surface 335A of the main surface portion 335 of the base member 33, on a side of the perpendicular back direction D22. The motor 361 serves as an actuator that moves the stapler 31 in the perpendicular direction D2 and rotates the stapler 31 around a hypothetical rotational shaft that extends in the upward and downward directions D3, via the first pulley 362, the endless belt 364, the second slider 35 and the movable table 32. In other words, the movable table rectilinearly driving portion and the movable table rotationally driving portion are driven by the motor 361 of the same actuator.

The first pulley 362 and the second pulley 363 are disposed on a side of the bottom surface 335B of the main surface portion 335 of the base member 33. The first pulley 362 is positioned on a side of the perpendicular back direction D22. The second pulley 363 is positioned on a side of the perpendicular front direction D21. The first pulley 362 and second pulley 363 are supported rotatably relative to the main surface portion 335. The endless belt 364 is entrained about the first pulley 362 and second pulley 363. The first pulley 362 is directly coupled to the motor 361 via a shaft, and functions as a drive pulley rotationally driven by the motor 361. The second pulley 363 functions as a follower pulley that follows the rotational drive of the first pulley 362 via the endless belt 364.

The endless belt 364 is entrained about the first pulley 362 and second pulley 363. A straight portion of the endless belt 364 extends along the perpendicular direction D2. The endless belt 364 functions as a transmission member that transmits rotational drive of the first pulley 362 to the second pulley 363, and as a conversion member that converts this rotational drive to rectilinear movement in the perpendicular direction D2.

The slide shaft 365 guides sliding movement for the second slider 35. The slide shaft 365 is inserted into the pair of sliding holes 354, 354 traversing these holes. The slide shaft 365 is supported in vicinities of both ends of the slide shaft 365 by support holes 337, 337 provided in the pair of hanging portions 336, 336.

In this manner, the second slider 35 is freely movable in the perpendicular direction D2. More specifically, when the motor 361 rotates, the first pulley 362 rotates accordingly to cause the endless belt 364 to rectilinearly move in the perpendicular direction D2. The second slider 35 is linked to the endless belt 364 via the linking portion 355. In addition, the direction of movement (sliding direction) of the second slider 35 is restricted to the perpendicular direction D2 by the sliding shaft 365. In this manner, the second slider 35 only moves in the perpendicular direction D2.

In the staple processing unit 3 of this embodiment, the movable table rectilinearly driving portion is configured by the guide groove engagement portions 341 that are inserted into the perpendicular groove 332 of the guide groove 331, and the long hole engagement portion 351 that is inserted into the long conveyance direction hole 322 of the long hole portion 321. Also, the movable table rotationally driving portion is configured by the guide groove engagement portions 341 that move between the perpendicular groove 332 and the tilted groves 333 of the guide groove 331, and the long hole engagement portion 351 that moves between the long conveying-direction hole 322 and the long tilting direction holes 323 of the long hole portion 321. The tilt retention portion is configured by the guide groove engagement portions 341 that are inserted into the tilted grooves 333 of the guide groove 331, and the long hole engagement portion 351 that is inserted into the long tilting direction holes 323 of the long hole portion 321, when a direction in which a long tilting direction hole 323 of the long hole portion 321 extends substantially matches the perpendicular direction D2.

The process for moving the stapler 31 in the perpendicular direction D2 and tilting the movable table 32 with respect to the sheet-conveyance direction D1 will now be explained with reference to FIGS. 11A to 11E. Descriptions will now be given for a case where the stapler 31 and the movable table 32 move in the perpendicular front direction D21. FIGS. 11A to 11E are views sequentially showing the process to tilt the movable table 32 in the staple processing unit 3. Portions other than the stapler 31 and the guide groove engagement portions 341 of the first slider 34 are omitted in FIGS. 11A to 11E.

Figure 11A:
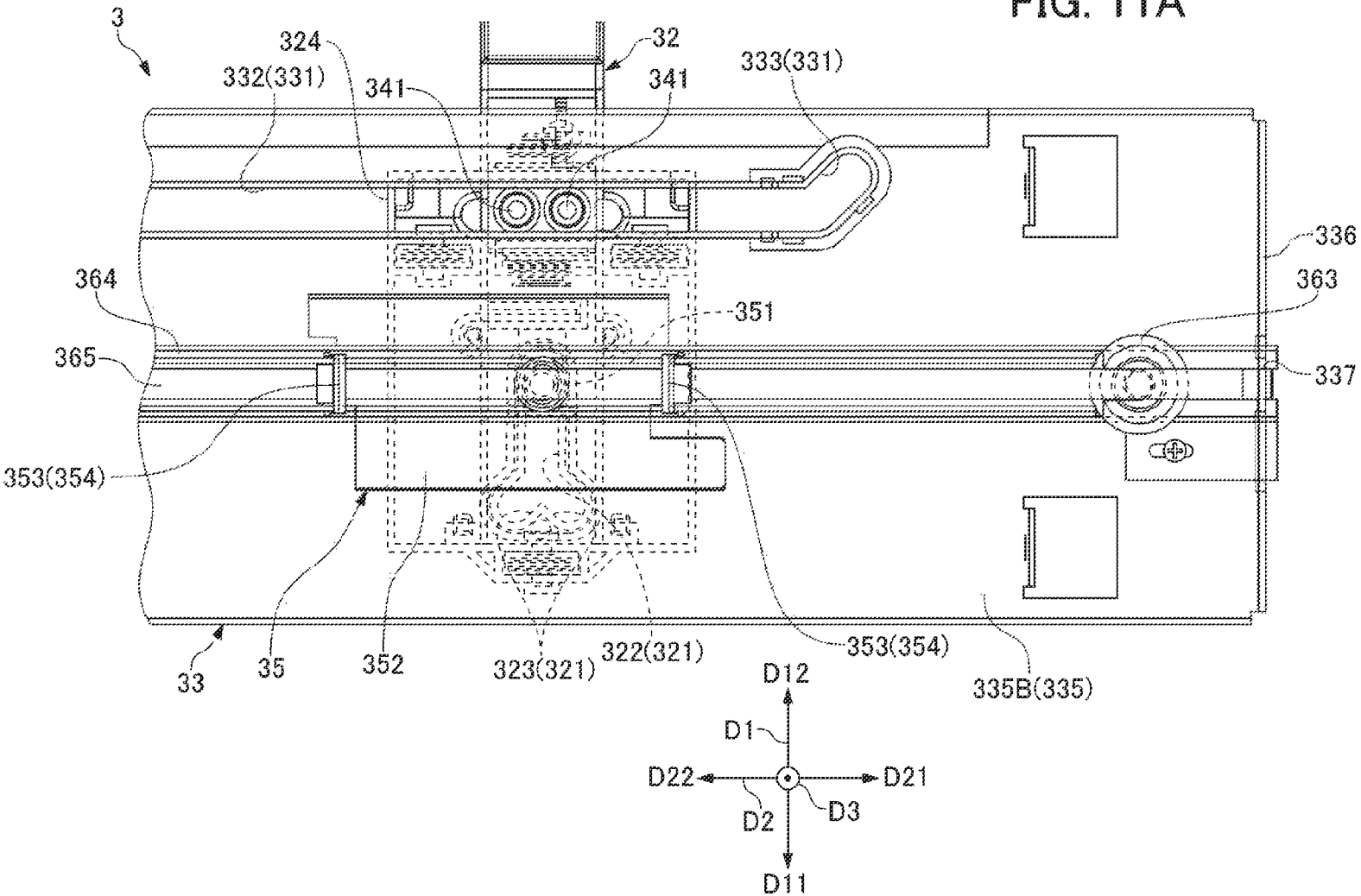
FIG. 11A is a view showing a sequence to tilt the movable table 32 of the staple processing unit 3 while the movable table 32 is not tilted, when viewed from a lower direction.
Figure 11B:
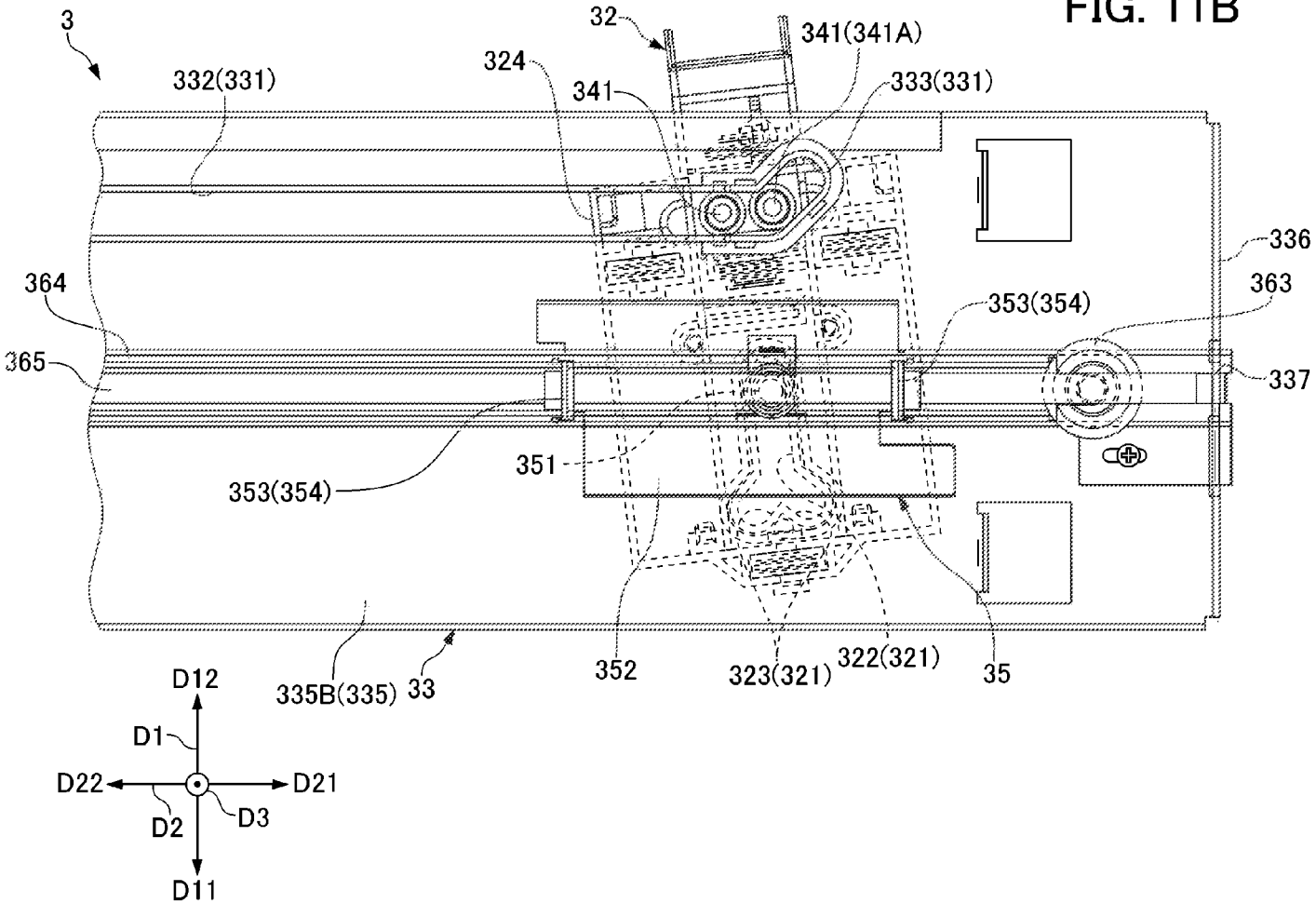
FIG. 11B is a view showing the movable table 32 beginning to tilt from the state shown in FIG. 11A.
Figure 11C:
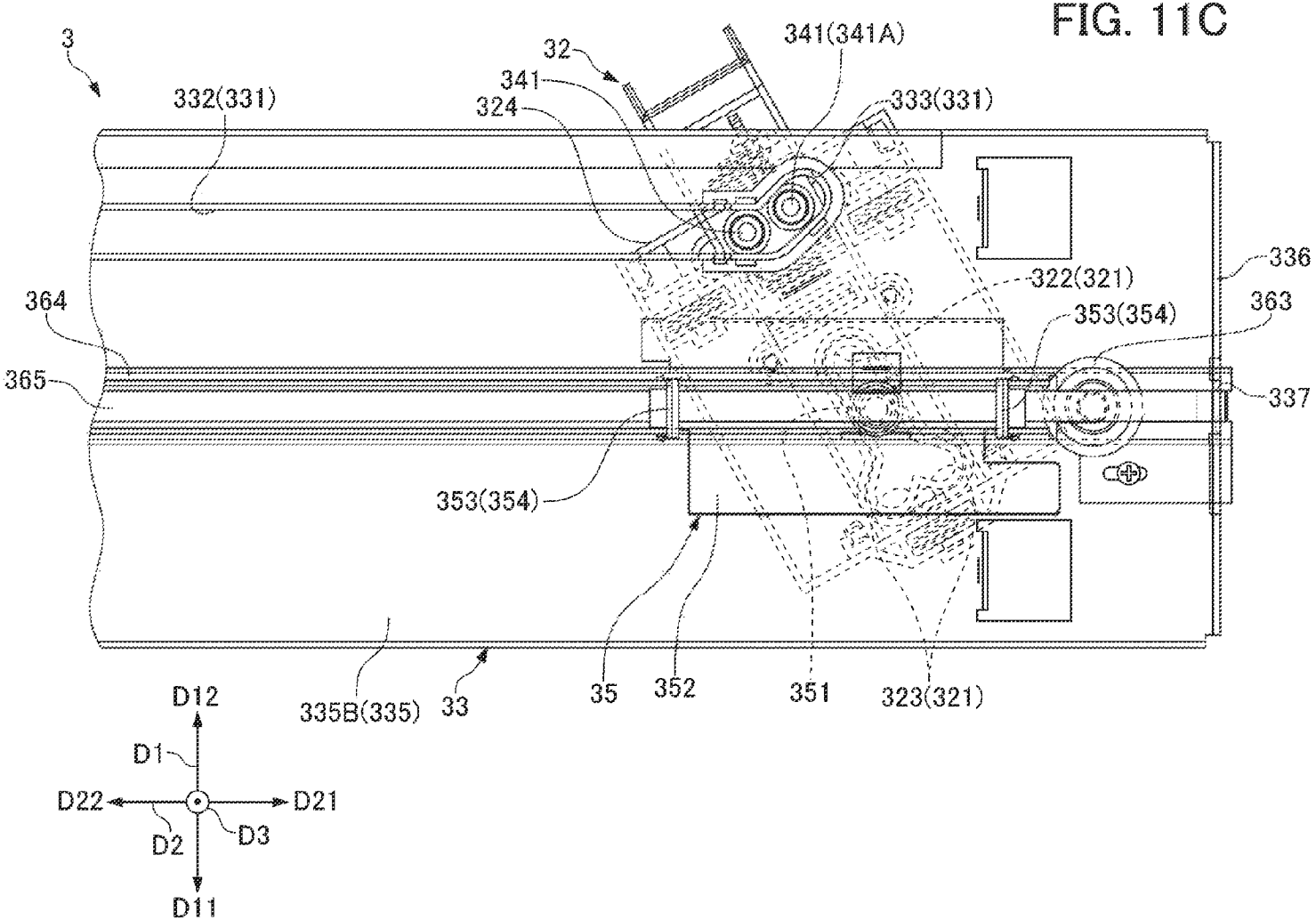
FIG. 11C is a view showing the movable table 32 further tilted from the state shown in FIG. 11B.
Figure 11D:
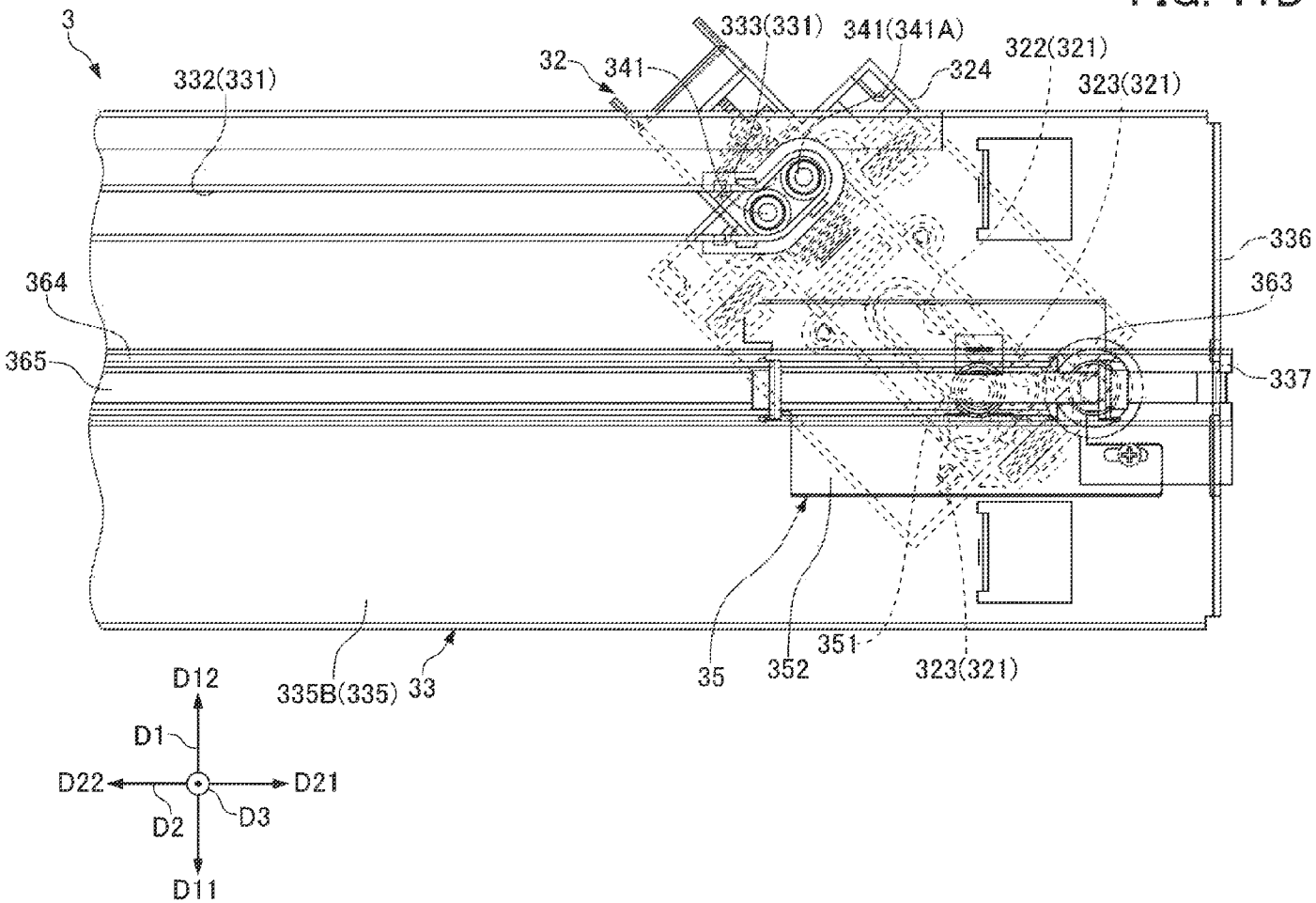
FIG. 11D is a view showing a state in which the movable table 32 is tilted from the state shown in FIG. 11C.
Figure 11E:
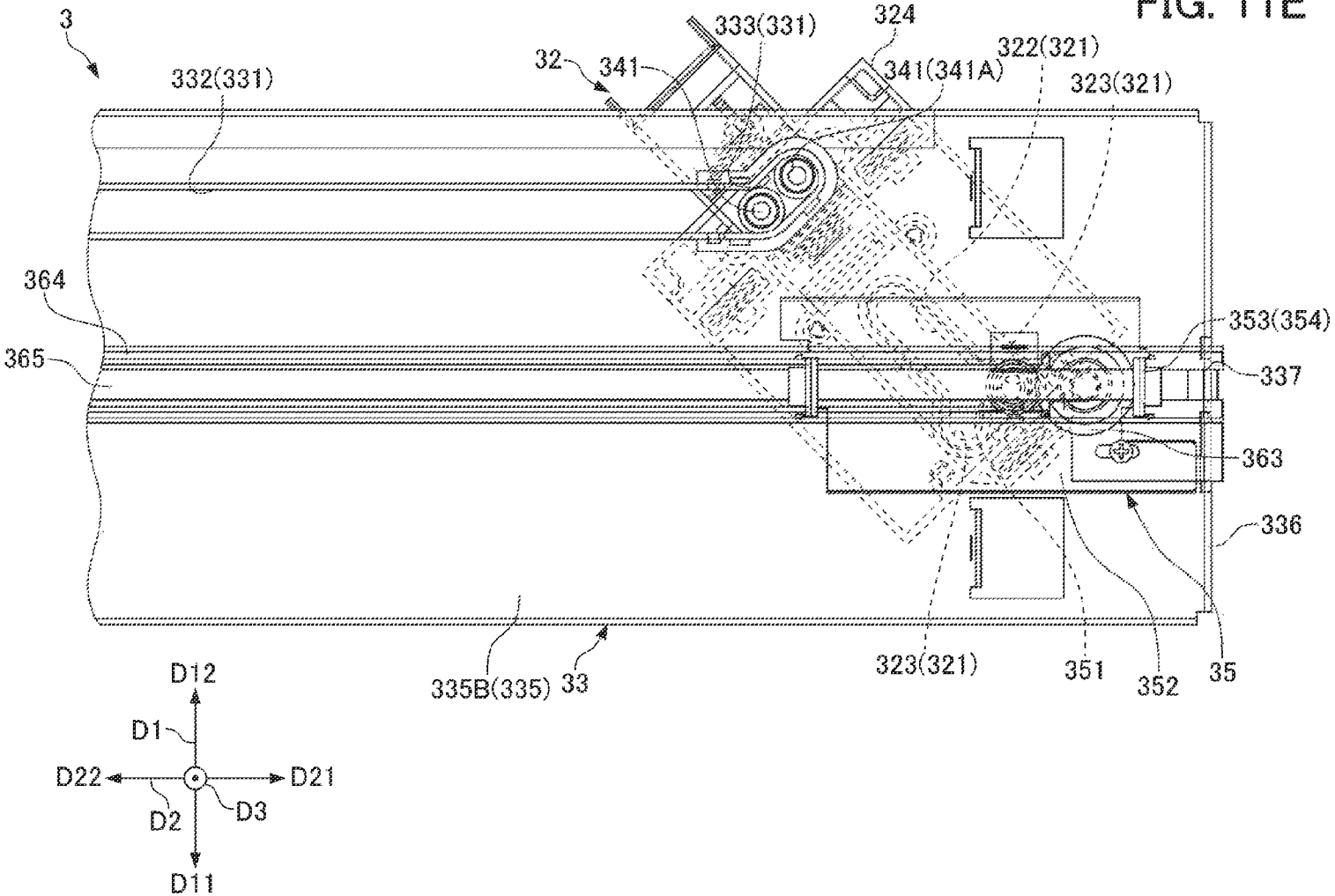
FIG. 11E is a view showing the movable table 32 mechanically held, changing from the state shown in FIG. 11D.

FIG. 11A is a view showing the movable table 32 not tilted when viewed from a lower direction. FIG. 11B is a view showing the movable table 32 beginning to tilt from the state shown in FIG. 11A. FIG. 11C is a view showing the movable table 32 to be further tilted from the state shown in FIG. 11B. FIG. 11D is a view showing the movable table 32 to be tilted from the state shown in FIG. 11C. FIG. 11E is a view showing the movable table 32 to be mechanically held from the state shown in FIG. 11D.

As shown in FIG. 11A, the two guide groove engagement portions 341, 341 are arranged in the perpendicular direction D2, in other words, in a direction in which the perpendicular groove 332 extends, when the movable table 32 moves in the perpendicular direction D2. In addition, the long conveyance direction hole 322 of the movable table 32 extends in the sheet-conveyance direction D1 (not extending in the perpendicular direction D2). Accordingly, when the second slider 35 moves in the perpendicular direction D2, the movable table 32 moves via the long hole engagement portion 351 and long conveyance direction hole 322. Since the direction of movement of the guide groove engagement portions 341 is restricted by the perpendicular groove 332 to the perpendicular direction D2, the movable table 32 moves in the perpendicular direction D2 (the perpendicular front direction D21).

When the movable table 32 continues moving in the perpendicular front direction D21, a guide groove engagement portion 341 (341A), which lies on a side of the perpendicular front direction D21, moves from the perpendicular groove 332 to a tilted groove 333 of the guide groove 331, as shown in FIGS. 11B and 11C. In this manner, a direction of arrangement of the two guide groove engagement portions 341, 341 begins to tilt with respect to the perpendicular groove 332. In this manner, the movable table 32 begins rotating counterclockwise when viewed in the upward direction D31. Accordingly, a direction in which the long conveyance direction hole 322 of the long hole portion 321 extends is tilted with respect to the perpendicular direction D2 and the sheet-conveyance direction D1. As a result, the long hole engagement portion 351 moves toward a long tilting direction hole 323 along the long conveyance direction hole 322.

When the movable table 32 continues to move further in the perpendicular front direction D21, the guide groove engagement portion 341 (341A), which lies on a side of the perpendicular front direction D21, moves near an end of the perpendicular groove 333, as shown in FIG. 11D. Here, the rotation of the movable table 32 (and stapler 31) ends. Simultaneously, the long hole engagement portion 351 is positioned at a connecting portion of the long conveyance direction hole 322 and the two long tilting direction holes 323 in the long hole portion 321. Also, a direction in which a long tilting direction hole 323 of the long hole portion 321 extends is substantially parallel to the perpendicular direction D2.

When the movable table 32 continues to move further in the perpendicular front direction D21, the long hole engagement portion 351 moves along the long tilting direction hole 323 lying on the side of the perpendicular front direction D21, from the connecting portion of the long conveyance direction hole 322 and two long tilting direction holes 323 toward the perpendicular front direction D21 as shown in FIG. 11E. Accordingly, the long hole engagement portion 351 moves up to near an end of this long tilting direction hole 323.

Under the condition described above, a direction in which the long tilting direction hole 323 of the long hole portion 321 extends is substantially parallel to the perpendicular direction D2. In this manner, the movable table 32 is mechanically held to maintain tilting of the stapler 31.

Figure 12:
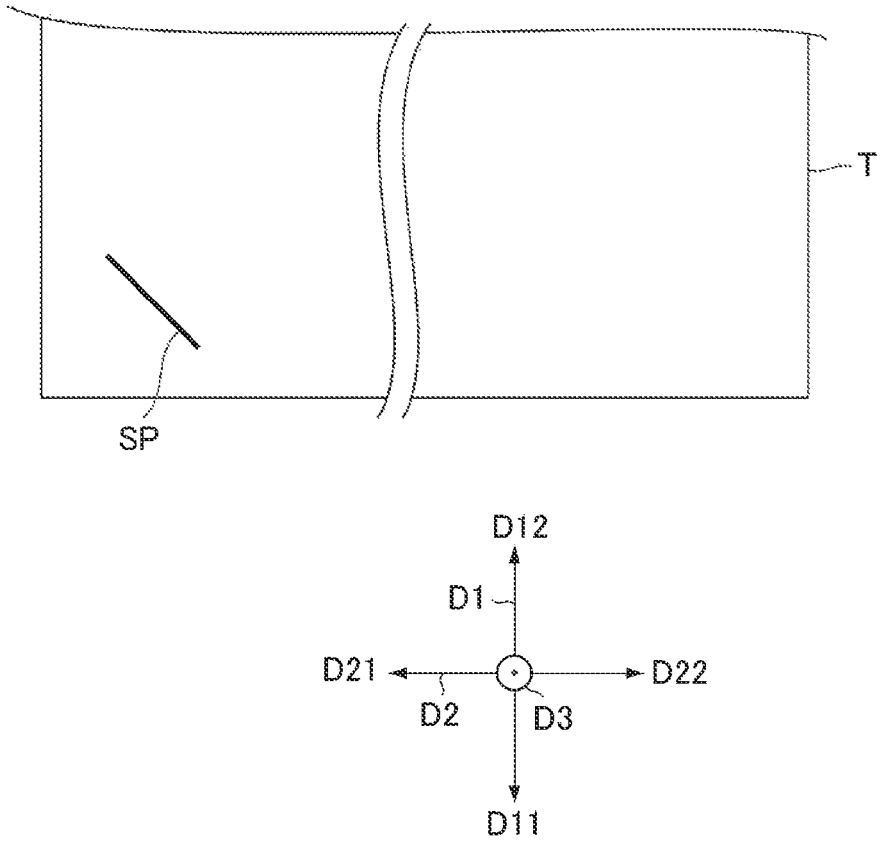
FIG. 12 is a view of the tilted edge-binding process in which a staple SP is driven near a corner of stacked sheets T while the stapling unit is tilted at a predetermined angle with respect to a direction of conveyance of a sheet D1, when viewed from an upper direction.

As described above, the staple processing unit 3 rotates the stapler 31 after it moves rectilinearly in the perpendicular direction D2. In addition, as shown in FIG. 12, the staple processing unit 3 drives a staple SP near a corner portion of the sheets T while the staple SP is tilted to a predetermined angle with respect to the sheet-conveyance direction D1 and the perpendicular direction D2.

The following effects are attained, for example, with the sheet post-processing apparatus 1 of this embodiment of the present invention.

The sheet post-processing apparatus 1 according to this embodiment includes the movable table rotationally driving portion that rotates the movable table 32 to cause the stapler 31 to tilt such that a staple SP tilted with respect to the sheet-conveyance direction D1 is driven, and the tilt retention portion that mechanically holds the movable table 32 so as to maintain the stapler 31 tilted.

Since the stapler 31 is mechanically held tilted, it is possible to maintain the stapler 31 tilted without a setup that electrically locks an actuator such as a motor for rotationally driving the stapler 31.

In addition, since the stapler 31 is mechanically held tilted, it is easier to replenish staples SP when the stapler 31 is tilted, even if the power of the drive unit is turned off when the cover of the housing 11 of the sheet post-processing apparatus 1 is opened.

Also, in the sheet post-processing apparatus 1 according to this embodiment, the movable table rectilinearly driving portion is configured by the guide groove engagement portions 341 that are inserted into the perpendicular groove 332 and the long hole engagement portion 351 that is inserted into the long conveyance direction hole 322. The movable table rotationally driving portion is configured by the guide groove engagement portions 341 that move between the perpendicular groove 332 and the tilted grooves 333 and the long hole engagement portion 351 that moves between the long conveyance direction hole 322 and the long tilting direction holes 323. The tilt retention portion is configured by the guide groove engagement portions 341 that are inserted into the tilted grooves 333, and the long hole engagement portion 351 that is inserted into the long tilting direction holes 323, when the direction in which the long tilting direction holes 323 extends substantially matches the perpendicular direction D2.

Accordingly, it is possible to implement the movable table rectilinearly driving portion, movable table rotationally driving portion and the tilt retention portion with a comparatively simple setup. Also, it is easy to drive the movable table rectilinearly driving portion and movable table rotationally driving portion using the same actuator.

Also, in the sheet post-processing apparatus 1 according to this embodiment, the movable table rectilinearly driving portion and the movable table rotationally driving portion are driven by the same actuator. Accordingly, the number of actuators is reduced.

A preferred embodiment of the sheet post-processing apparatus 1 has been explained, but the embodiment is not to be construed as a limitation; a variety of embodiments can be adopted.

Figure 13:
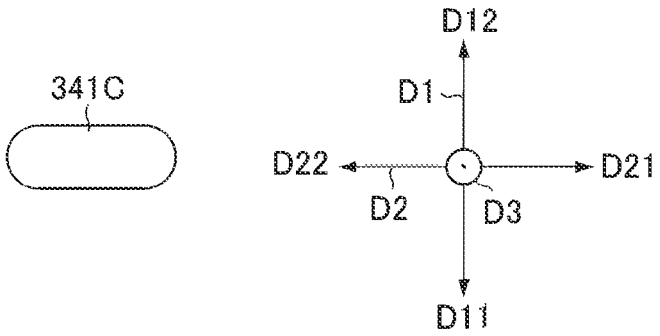
FIG. 13 is a view showing a guide groove engagement portion 341C of a first modification that extends along an extending direction of the guide groove 331.
Figure 14:
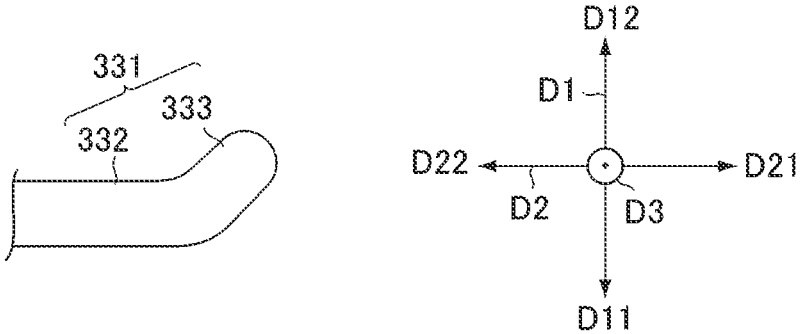
FIG. 14 is a view showing a guide groove 331 that corresponds to the guide groove engagement portion 341C shown in FIG. 13.
Figure 15:
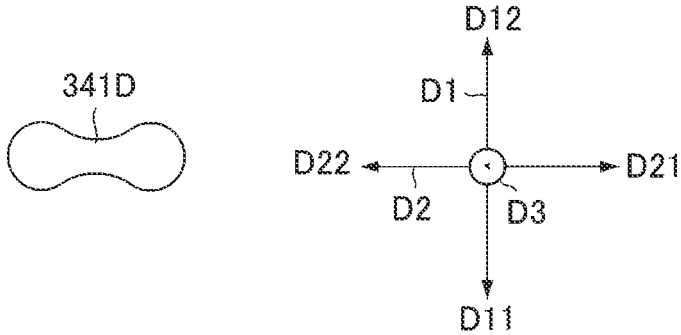
FIG. 15 is a view showing a guide groove engagement portion 341D of a second modification that extends along the extending direction of the guide groove 331.

FIG. 13 is a view showing a guide groove engagement portion 341C of a first modification extending in a direction in which a guide groove 331 extends. FIG. 14 is a view showing the guide groove 331 that corresponds to the guide groove engagement portions 341C shown in FIG. 13. FIG. 15 is a view showing a guide groove engagement portion 341D of a second modification extending in a direction in which a guide groove 331 extends.

Two guide groove engagement portions 341 are arranged along the direction (the perpendicular direction D2) in which the guide groove 331 (perpendicular groove 332) extends. However, it is not limited to this configuration. For example, the guide groove engagement portion 341C of the first modification is configured to extend along a direction (the perpendicular direction D2) in which the guide groove 331 (perpendicular groove 332) extends, as shown in FIG. 13.

In such a case, ends of the guide groove engagement portion 341C in directions in which it extends are preferably rounded. Also, it is preferable that a connecting portion of the perpendicular groove 332 and a tilted groove 333 in the guide groove 331 is smoothly curved, as shown in FIG. 14. Accordingly, the guide groove engagement portion 341C of the first modification shown in FIG. 13, which extends in a direction in which the guide groove 331 extends, easily moves between the perpendicular groove 332 and the tilted groove 333.

Also, a central portion of the guide groove engagement portion 341D of the second modification is narrower than a width of both ends thereof relative to a direction in which the guide groove engagement portion 341D extends, compared to the guide groove engagement portion 341C of the first embodiment shown in FIG. 13. More specifically, the width of the central portion of the guide groove engagement portion 341D (the width along a direction perpendicular to a direction in which the guide groove engagement portion 341D extends) is narrowed. The guide groove engagement portion 341D of the second modification having such a narrowed shape smoothly moves between the perpendicular groove 332 and the tilted grooves 333 in the guide groove 331 similar to the guide groove engagement portions 341 of the embodiment described above, although it is an integral one body similar to the guide groove engagement portion 341C of the first modification.

In addition, it may be possible that three or more guide groove engagement portions 341 are adopted.

It may be that the tilted groove 333 is provided only at one end of the perpendicular groove 332.

The present invention is not limited to any type of sheet post-processing apparatus. It may be adapted to any type of sheet post-processing apparatus.

The present invention is not limited to any type of image forming apparatus, either. A copying machine, printer, facsimile or any combination of these may be acceptable.

Sheets are not limited to paper. Film sheets, for example, may also be used.

What is claimed is:

1. A sheet post-processing apparatus, comprising:

a stapling unit configured to drive a staple into a plurality of stacked sheets;

a movable table configured to rectilinearly move in unison with the stapling unit in a perpendicular direction perpendicular to a direction of conveyance of a sheet;

a rectilinearly driving portion configured to rectilinearly move the movable table in the perpendicular direction, the rectilinearly driving portion causing the stapling unit to rectilinearly move through the movable table, such that the sheet post-processing apparatus performs tilted stapling with the stapling unit that drives the staple into the plurality of stacked sheets in a vicinity of a corner thereof in such a manner that the staple has a predetermined angle with respect to the direction of the conveyance of a sheet;

a rotationally driving portion configured to cause the movable table to rotate such that the stapling unit is tilted so as to drive the staple at the predetermined angle with respect to the direction of the conveyance of a sheet;

a tilt retention portion configured to mechanically hold the movable table such that the stapling unit maintains a tilted state;

a base member;

a guide groove that is disposed in the base member, including a perpendicular groove configured to extend along the perpendicular direction and a tilted groove configured to extend along a tilted direction tilted at the predetermined angle with respect to the direction of the conveyance of a sheet;

a guide groove engagement portion that is disposed or extended along an extending direction of the guide groove and inserted in the guide groove such that the guide groove engagement portion is connected to the movable table on a side of the base member;

a long hole that is disposed at the movable table on the side of the base member, including a long hole of a conveyance direction and a long hole of a tilting direction, the long hole of the conveyance direction extending in the direction of the conveyance of a sheet in a matched state where a direction in which the guide groove engagement portion is disposed or extends matches a direction in which the perpendicular groove of the guide groove extends, and the long hole of the tilting direction continuing from the long hole of the conveyance direction and extending at an angle with respect to the direction of the conveyance of a sheet in the matched state; and a long hole engagement portion inserted into the long hole, and configured to be movable in the perpendicular direction with respect to the base member; wherein the rectilinearly driving portion is configured by the guide groove engagement portion being inserted in the perpendicular groove and the long hole engagement portion being inserted in the long hole of the conveyance direction;

the rotationally driving portion is configured by the guide groove engagement portion moving between the perpendicular groove and the tilted groove and the long hole engagement portion moving between the long hole of the conveyance direction and the long hole of the tilting direction; and the tilt retention portion is configured by the guide groove engagement portion being inserted in the tilted groove and the long hole engagement portion being inserted in the long hole of the tilting direction, when a direction in which the long hole of the tilting direction extends substantially matches the perpendicular direction.

2. The sheet post-processing apparatus according to claim 1, wherein the rectilinearly driving portion and the rotationally driving portion are driven by a same actuator.

3. An image forming apparatus comprising:

a main body including an image forming unit that forms an image on a sheet; and the sheet post-processing apparatus according to claim 1.

4. An image forming apparatus comprising:

a main body including an image forming unit that forms an image on a sheet; and the sheet post-processing apparatus according to claim 2.

* * * * *